US008237616B2

(12) United States Patent
Das

(10) Patent No.: US 8,237,616 B2
(45) Date of Patent: Aug. 7, 2012

(54) FREE-SPACE WAVEGUIDES, INCLUDING AN ARRAY OF CAPACITIVELY LOADED CONDUCTING RING ELEMENTS, FOR GUIDING A SIGNAL THROUGH FREE SPACE

(75) Inventor: Nirod K. Das, Ledgewood, NJ (US)

(73) Assignee: Polytechnic Institute of New York University, Brooklyn, NY (US)

( * ) Notice: Subject to any disclaimer, the term of this patent is extended or adjusted under 35 U.S.C. 154(b) by 376 days.

(21) Appl. No.: 12/642,591

(22) Filed: Dec. 18, 2009

(65) Prior Publication Data

US 2010/0214042 A1 Aug. 26, 2010

Related U.S. Application Data

(60) Provisional application No. 61/139,045, filed on Dec. 19, 2008.

(51) Int. Cl.
*H01Q 13/00* (2006.01)

(52) U.S. Cl. ..... 343/772; 333/248

(58) Field of Classification Search ..... 343/772; 333/205, 239, 248
See application file for complete search history.

(56) References Cited

U.S. PATENT DOCUMENTS

| | | | | |
|---|---|---|---|---|
| 3,922,621 | A * | 11/1975 | Gruner | 333/117 |
| 4,538,125 | A * | 8/1985 | Beckmann et al. | 333/248 |
| 4,812,790 | A * | 3/1989 | Tatomir et al. | 333/212 |
| 5,276,457 | A * | 1/1994 | Agarwal et al. | 343/789 |
| 7,095,379 | B2 * | 8/2006 | Pryor et al. | 343/786 |
| 7,425,930 | B2 * | 9/2008 | Lyons et al. | 343/830 |

* cited by examiner

*Primary Examiner* — Tan Ho
(74) *Attorney, Agent, or Firm* — John C. Pokotylo; Straub & Pokotylo

(57) ABSTRACT

A "wireless cable" (also referred to as a "free-space waveguide"), which does not require a continuous body of conducting wire, is provided. Rather, a series of conducting rings, each loaded with a suitable capacitance element, is properly arranged in an empty medium. The distance between the conducting ring elements is of the order of half the wavelength of the signal to be carried, or less. Normally, the series of ring elements would operate as an antenna array, radiating the signal power away from the structure. However, under suitable design conditions, ideally all the signal power can be directed along an axis of the series of conducting ring elements. A signal source can be connected to the ring element at one end of the series, and a suitable electrical load be connected to the element at the opposite end to collect the guided signal power. Additional matching circuits may be provided to properly couple the source and load to the wireless cable.

15 Claims, 19 Drawing Sheets

100

200

1600

FREE-SPACE WAVEGUIDES, INCLUDING AN ARRAY OF CAPACITIVELY LOADED CONDUCTING RING ELEMENTS, FOR GUIDING A SIGNAL THROUGH FREE SPACE

§0. RELATED APPLICATIONS

Benefit is claimed, under 35 U.S.C. §119(e)(1), to the filing date of U.S. provisional patent application Ser. No. 61/139,045 (referred to as "the '045 provisional"), titled "A 'WIRELESS CABLE' INCLUDING AN ARRAY OF CAPACITIVELY LOADED CONDUCTING STRIPS, ALLOWING GUIDANCE OF RADIO WAVES THROUGH FREE SPACE, FOR USE AS AN ECONOMIC, LIGHT-WEIGHT SUBSTITUTE FOR CONVENTIONAL SIGNAL CABLES," filed on Dec. 19, 2008 and listing Nirod DAS as the inventor, for any inventions disclosed in the manner provided by 35 U.S.C. §112, ¶ 1. The '045 provisional application is expressly incorporated herein by reference. The scope of the present invention is not limited to any requirements of the specific embodiments described in the '045 provisional application.

§1. BACKGROUND OF THE INVENTION

§1.1 Field of the Invention

The present invention concerns transmitting signals. In particular, the present invention concerns the guidance of radio waves through free space, such as for use as an economic, light-weight, substitute for conventional signal cables.

§1.2 Background Information

Conventional cables use a continuous body of conducting material for transmission of electrical signals from an input source to a distant load. This type of a cable, such as a coaxial cable, may be used for direct current (DC), as well as radio frequency (RF) signals. However, such cables become ineffective at higher frequencies due to power loss in the conducting material.

For such high-frequency radio waves (and for optical signals), signal propagation is possible using cables made of continuous dielectric material. Such cables, for example an optical fiber, are referred to as "dielectric waveguides." However, dielectric waveguides also use a continuous material body to transfer signal power from a source at one end of the waveguide to a distant load (or receiver) at the other end.

Unfortunately, cables and waveguides used for carrying signals have certain disadvantages due to their requirement of having continuous material. Consider, for example, a cable carrying a signal from an antenna in the attic of a home, to a room at the other end of the home. Obstructions such as ceilings/floors and walls must be provided with openings to allow the cable to pass. As another disadvantage, the need for continuous material places a limit on how light the cable may be, or how little material may be used per length of "signal carry". Finally, the cable may be inadvertently severed or otherwise compromised at any point along its length.

Therefore, it would be useful to allow signals to be "carried" from a source point to a load (or sink) point by a means without the above-mentioned disadvantages of cables and waveguides.

Signals can be also be transmitted through an empty space, using a pair of antennas to transmit and receive radiation. Unfortunately, however, in the process of such signal transmission through an empty space, the signal power is lost in various arbitrary directions. Consequently, only a very negligible fraction of the power of the signal radiation transmitted from the transmitting antenna is collected by the receiving antenna. While this process may be acceptable for information communication between distant points, it is not useful to transfer signal power.

Although the percentage of power transferred through the empty space received may be increased by using large antennas to better focus the radiation in the specific direction between the transmit and receive points, this may only be practical over a limited distance. This is because as the distance is increased, the power received would be reduced with the square of the distance. Furthermore, larger antennas are not practical for many applications. Transmitting signals through an empty space using a pair of antennas to transmit and receive radiation is, by nature, not well suited for directing or guiding the signal. This is because the free-space medium has a natural tendency to spread or diffract the signal.

Therefore, it would be useful to allow signals to be "carried" from a source point to a load (or sink, or reception) point by means without the above-mentioned disadvantages of transmit and receive antennas (and without the above-mentioned disadvantages of cables and waveguides).

§2. SUMMARY OF THE INVENTION

Embodiments consistent with the present invention can be used to meet the foregoing needs by providing a free-space waveguide for transmitting a signal, having a wavelength lambda, from an input end to an output end, the free-space waveguide comprising a plurality of conducting ring elements. Each of the plurality of conducting ring elements is separated from at least one adjacent conducting ring element by a distance of less than lambda/2. Each of the plurality of conducting ring elements includes a capacitor portion. Each of the plurality of conducting ring elements has a ring radius of a and a strip width of W. A capacitance of the capacitor portion has a capacitive reactance which is equal and opposite to an effective inductance L seen at the input of each conducting ring element, while they are all operating together. The free-space waveguide may be used in systems and methods for transmitting signals.

§3. BRIEF DESCRIPTION OF THE DRAWINGS

§4. DETAILED DESCRIPTION

The present invention may involve novel methods, apparatus, and/or systems for the guidance of a signal through free space. The following description is presented to enable one skilled in the art to make and use the invention, and is provided in the context of particular applications and their requirements. Thus, the following description of embodiments consistent with the present invention provides illustration and description, but is not intended to be exhaustive or to limit the present invention to the precise form disclosed. Various modifications to the disclosed embodiments will be apparent to those skilled in the art, and the general principles set forth below may be applied to other embodiments and applications. For example, although a series of acts may be described with reference to a flow diagram, the order of acts may differ in other implementations when the performance of one act is not dependent on the completion of another act. Further, non-dependent acts may be performed in parallel. Also, as used herein, the article "a" is intended to include one or more items. Where only one item is intended, the term "one" or similar language is used. In the following, "information" may refer to the actual information, or a pointer to, identifier of, or location of such information. No element, act or instruction used in the description should be construed as critical or essential to the present invention unless explicitly described as such. Thus, the present invention is not intended to be limited to the embodiments shown and the inventor regards his invention to include any patentable subject matter described.

§4.1 Exemplary Free-Space Waveguides

Figure 1:
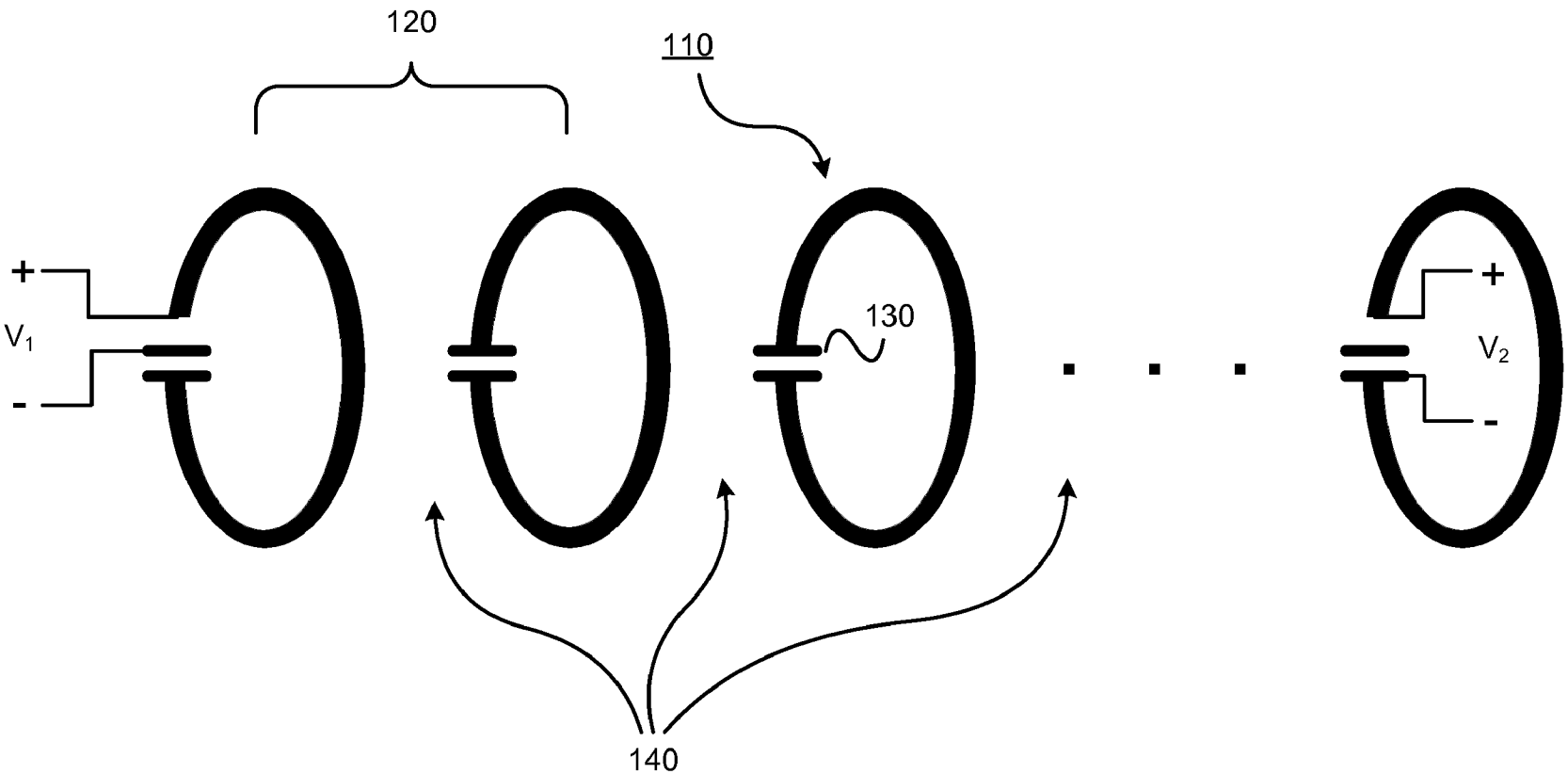
FIG. 1 is a diagram illustrating an exemplary free-space waveguide using an array of capacitively loaded conducting ring elements.

FIG. 1 is a diagram illustrating an exemplary free-space waveguide 100 using an array (e.g. provided in a periodic arrangement) of capacitively loaded conducting ring elements 110. Unlike conventional signal cable, the free-space waveguide 100 is not a continuous structure. Unlike transmit and receive antennas, it 100 is not an arrangement with all empty space between the end points.

In terms of the amount of material needed for the ring elements 110, the design structure may need only a fraction of that normally used in a conventional signal cable. However, the free-space waveguide 100 can direct or guide a signal along the axis of the conducting rings 110, ideally transferring all the signal power between two distant points. In this sense, the free-space waveguide 100 performs like a signal cable, but does not require a continuous material body between two points. Hence, the free-space waveguide 100 can be thought of as a "wireless cable." This is a unique feature of the free-space waveguide 100. The basic mechanism of the free-space waveguide, described below, may be referred to as "wireless power guidance," or "free space waveguidance."

Note that although FIG. 1 shows the ring elements 110 aligned linearly, the free-space waveguide 100 would still work even when the axis is "bent" like a conventional cable. There would be loss of only a negligible fraction of power if the axis is bent with radius of curvature which is significantly larger than a wavelength. For example, a radius of curvature of the bend on the order of 100 wavelengths or larger would be reasonable for practical designs. For situations when the curvature or bend of the axis is large, the free-space waveguide might employ a larger density of the ring elements 110 (that is, one might reduce the spacing of the ring elements 110) in the curved region to reduce any power loss in such a region.

The free-space waveguide 100 of FIG. 1 would theoretically allow total power transfer along the axis when the dimensions of the conducting ring elements 110, the separation 120 between the ring elements 110, and the value of the capacitance 130, are properly designed. The separation 120 between the ring elements 110 should be less than half a free-space wavelength of the signal to prevent power loss. Thus, depending on the frequency of the signal being carried, the physical separation 120 can be quite large. For example, for a signal frequency of 3 GHz (in which case the wavelength is 10 cm), the ring elements 110 may be separated by up to 5 cm. This separation limit would be increased to 15 cm for a signal frequency of 1 GHz. The principle of the design would remain the same for any signal frequency, and it may be possible to design the free-space waveguide 100 for a much lower frequency of operation, in which case the separation 120 can actually be considerably larger. For example, at 100 MHz, the separation 120 may be designed up to 150 cm.

Figure 2:
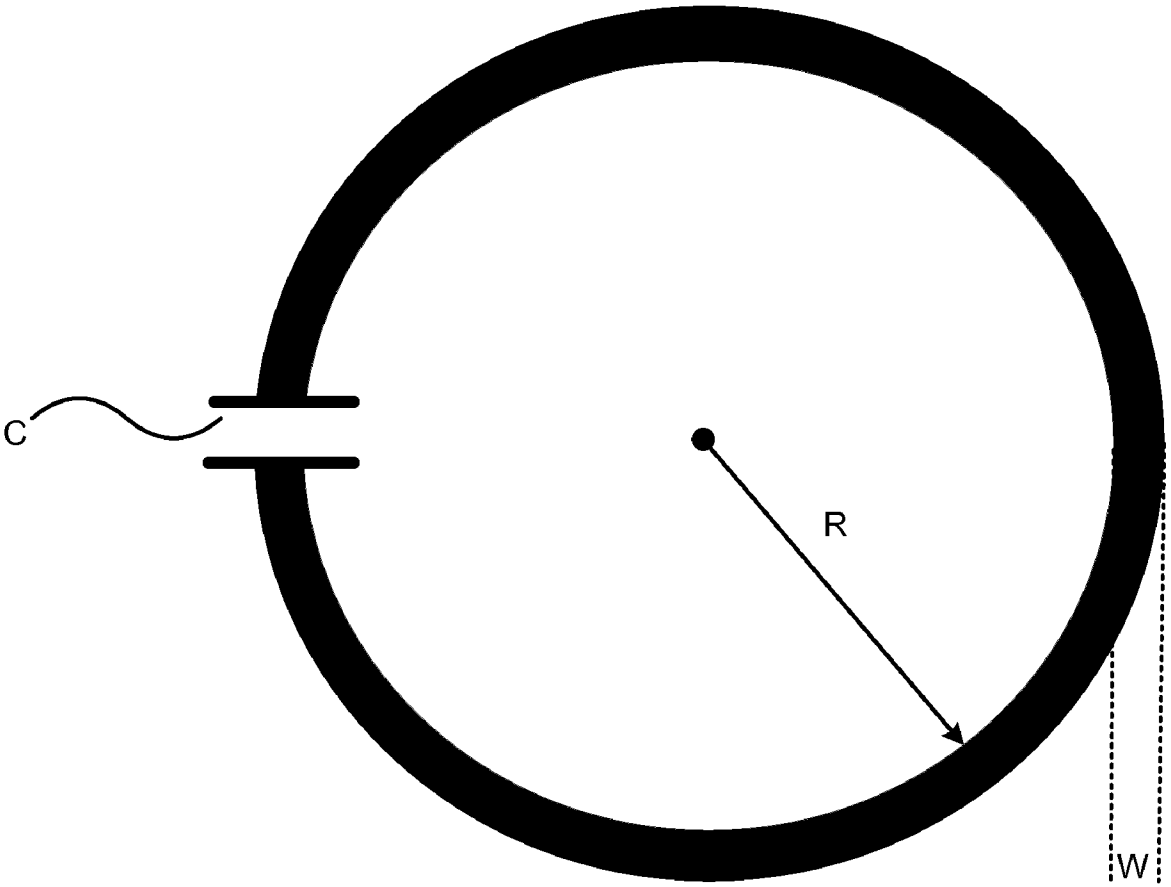
FIG. 2 illustrates a conducting ring element that might be used in a free-space waveguide such as the one illustrated in FIG. 1.

FIG. 2 illustrates basic parameters of a conducting ring element 200 that might be used in a free-space waveguide such as the one illustrated in FIG. 1. The letter "a" denotes the radius of the ring element 200, C denotes the capacitance of the ring element 200 and W denotes the width (or gauge) of the ring element 200. The interrelationship between these parameters will be discussed below.

Having introduced an exemplary free-space waveguide 100 and its components 200, the technical concept and physical underpinnings of the apparatus is now described, first with respect to a two-dimensional, circular current loop, and then with respect to coaxial arrays of circular current loops

§4.1.1 Discussion of Two-Dimensional, Circular Current Loop

Specifying a particular current distribution, expressions for the fields of a single, isolated, two dimensional current loop will be derived in this section. The driving point input impedance will also be expressed in terms of the field quantities. Whenever possible, the derived expressions are either analytically reduced, under limiting conditions, to already available expressions in the literature or are numerically evaluated and compared to the available expressions. The results of this section will be used later in the analysis of the array consisting of multiple loops of the type discussed here.

§4.1.1.1 Current Distribution

Figure 3:
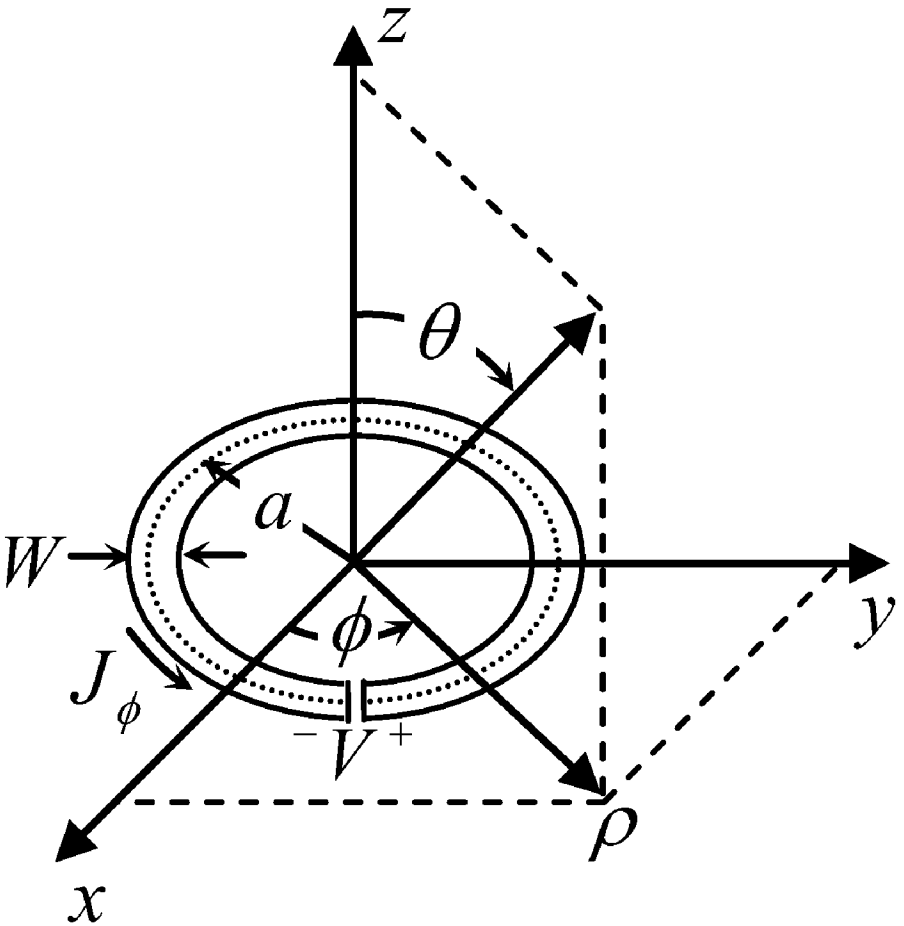
FIG. 3 illustrates the geometry of a two-dimensional loop in the x-y plane.

The geometry of a two-dimensional loop in the x-y plane is shown in FIG. 3. As a function of the cylindrical coordinates, the current density is assumed to be given by $$J = \begin{cases} u_\phi \dfrac{I_{in}}{\rho \ln(a_+/a_-)}, & |\rho - a| < \dfrac{W}{2},\ z = 0 \\ 0, & \text{otherwise,} \end{cases} \tag{1-1}$$

where $$u_\phi = -u_x \sin\phi + u_y \cos\phi,\ a_+ = a + \frac{W}{2},\ a_- = a - \frac{W}{2}$$

and $I_{in}$ is a complex constant. The current assumed is dual to the equivalent magnetic current commonly assumed for the coaxial line opening onto a ground plane (see for example the text, R. F. Harrington, "Time-Harmonic Electromagnetic Fields," NY, Wiley, 2001 or the article, A. Sakitani and S. Egashira, "Simplified expressions for the near fields of a magnetic frill current," IEEE Trans. Antennas Propagat., vol. 34, pp. 1059-1062, August 1986).

The transform of (1-1) may be expressed as:

$$\bar{J}(k_x, k_y) = \frac{-j2\pi I_{in}}{\ln(a_+/a_-)k_\rho^2}[J_0(k_\rho a_+) - J_0(k_\rho a_-)][u_x k_y - u_y k_x], \tag{1-2}$$

where $k_\rho^2 = k_x^2 + k_y^2$, and $J_n(\xi)$ is the Bessel function of the first kind of order n.

Using an inverse transform, Eq. (1-1) for the loop current density can be written as:

$$\begin{aligned} J(x, y, z = 0) &= \frac{1}{4\pi^2}\int_{-\infty}^{\infty}\int_{-\infty}^{\infty} \bar{J}(k_x, k_y) e^{jk_x x} e^{jk_y y} dk_x dk_y \\ &= \frac{-jI_{in}}{2\pi \ln(a_+/a_-)}\int_{-\infty}^{\infty}\int_{-\infty}^{\infty} \frac{[J_0(k_\rho a_+) - J_0(k_\rho a_-)]}{k_\rho^2} \\ &\quad [u_x k_y - u_y k_x] e^{jk_x x} e^{jk_y y} dk_x dk_y. \end{aligned} \tag{1-3}$$

§4.1.1.2 Electric and Magnetic Fields

The fields produced by the currents of (1-1) can be found for $I_{x0}(k_x, k_y)$, $I_{y0}(k_x, k_y)$ given by the x and y components of (1-2). However, the determination of the fields can be somewhat simplified by noting that the current density of (1-1) produces a $TE_z$ field. This is evident from (1-3) where the current density is expressed as a linear combination of currents that produces a $TE_z$ field. The result is:

$$E(x, y, z \gtrless 0) = \frac{jI_{in}\eta k}{4\pi \ln(a_+/a_-)}\int_{-\infty}^{\infty}\int_{-\infty}^{\infty} \frac{[J_0(k_\rho a_+) - J_0(k_\rho a_-)]}{k_z k_\rho^2}[u_x k_y - u_y k_x] e^{\mp jk_z z} e^{-jk_x x} e^{-jk_y y} dk_x dk_y \tag{1-4}$$

$$H(x, y, z \gtrless 0) = \frac{jI_{in}}{4\pi \ln(a_+/a_-)}$$

-continued $$\int_{-\infty}^{\infty}\int_{-\infty}^{\infty} \frac{[J_0(k_\rho a_+) - J_0(k_\rho a_-)]}{k_z k_\rho^2}\begin{bmatrix} \pm u_x k_x k_z \\ \pm u_y k_y k_z \\ -u_z k_\rho^2 \end{bmatrix} e^{\mp jk_z z} e^{-jk_x x} e^{-jk_y y} dk_x dk_y.$$

In terms of cylindrical coordinates and with the variables of integration transformed to polar coordinates ($k_x = k_\rho \cos\phi'$, $k_y = k_\rho \sin\phi'$, $dk_x dk_y = k_\rho d\phi' dk_\rho$), Eqs. (1-4) become:

$$E(\rho, \phi, z \gtrless 0) = \frac{jI_{in}\eta k}{4\pi \ln(a_+/a_-)}\int_0^{\infty}\int_0^{2\pi} \frac{[J_0(k_\rho a_+) - J_0(k_\rho a_-)]}{\sqrt{k^2 - k_\rho^2}}\begin{bmatrix} u_x \sin\phi' \\ -u_y \cos\phi' \end{bmatrix} e^{\mp j\sqrt{k^2 - k_\rho^2} z} e^{jk_\rho \rho \cos(\phi - \phi')} d\phi' dk_\rho \tag{1-5}$$

$$H(\rho, \phi, z \gtrless 0) = \frac{-jI_{in}}{4\pi \ln(a_+/a_-)}\int_{-\infty}^{\infty}\int_{-\infty}^{\infty} [J_0(k_\rho a_+) - J_0(k_\rho a_-)]\begin{bmatrix} \pm u_x \cos\phi' \\ \pm u_y \sin\phi' \\ -u_z \dfrac{k_\rho}{\sqrt{k^2 - k_\rho^2}} \end{bmatrix} e^{\mp j\sqrt{k^2 - k_\rho^2} z} e^{jk_\rho \rho \cos(\phi - \phi')} d\phi' dk_\rho.$$

Further simplification is achieved by finding a closed form expression for the $\phi'$ integration. The result is:

$$E(\rho, \phi, z \gtrless 0) = \frac{-I_{in}\eta k}{2\ln(a_+/a_-)}\int_0^{\infty} \frac{[J_0(k_\rho a_+) - J_0(k_\rho a_-)]}{\sqrt{k^2 - k_\rho^2}} J_1(k_\rho \rho)[u_x \sin\phi - u_y \cos\phi] e^{\mp j\sqrt{k^2 - k_\rho^2} z} dk_\rho \tag{1-6}$$

$$H(\rho, \phi, z \gtrless 0) = \frac{I_{in}}{2\ln(a_+/a_-)}\int_0^{\infty} [J_0(k_\rho a_+) - J_0(k_\rho a_-)] J_1(k_\rho \rho)\begin{bmatrix} \pm u_x \cos\phi \pm u_y \sin\phi \\ -u_z \dfrac{k_\rho}{\sqrt{k^2 - k_\rho^2}} \end{bmatrix} e^{\mp j\sqrt{k^2 - k_\rho^2} z} dk_\rho.$$

In terms of the cylindrical unit vectors, (1-6) can be written as:

$$E(\rho, \phi, z \gtrless 0) = u_\phi \frac{I_{in}\eta k}{2\ln(a_+/a_-)}\int_0^{\infty} \frac{[J_0(k_\rho a_+) - J_0(k_\rho a_-)]}{\sqrt{k^2 - k_\rho^2}} J_1(k_\rho \rho) e^{\mp j\sqrt{k^2 - k_\rho^2} z} dk_\rho \tag{1-7}$$

$$H(\rho, \phi, z \gtrless 0) = \frac{I_{in}}{2\ln(a_+/a_-)}\int_0^{\infty} [J_0(k_\rho a_+) - J_0(k_\rho a_-)] J_1(k_\rho \rho)\left[\pm u_\rho - u_z \frac{k_\rho}{\sqrt{k^2 - k_\rho^2}}\right] e^{\mp j\sqrt{k^2 - k_\rho^2} z} dk_\rho.$$

The radiation zone fields can be expressed as:

$$E_\phi(r,\theta,\phi) = -\frac{I_{in}\eta}{2\ln(a_+/a_-)}\frac{\begin{bmatrix} J_0(k\sin\theta a_+) - \\ J_0(k\sin\theta a_-) \end{bmatrix}}{\sin\theta}\frac{e^{-jkr}}{r}. \tag{1-8}$$

For W<<a, a simplification of (1-7) and (1-8) is possible. Using the truncated Taylor series approximation for ln(ξ) around ξ=a to obtain:

$$\frac{1}{\ln(a_+/a_-)} = \frac{a}{W}, \tag{1-9}$$

and the finite difference approximation to the derivative, which gives:

$$\begin{aligned} J_0(k_\rho a + k_\rho W) - J_0(k_\rho a - k_\rho W) &\cong \frac{dJ_0(z)}{dz}\Big|_{z=k_\rho a}\cdot 2k_\rho\frac{W}{2} \\ &= -J_1(k_\rho a)k_\rho W, \end{aligned} \tag{1-10}$$

Eq. (1-7) reduces to:

$$\begin{aligned} &E(\rho,\phi,z \gtrless 0) = \\ &\quad -u_\phi\frac{I_{in}\eta ka}{2}\int_0^\infty J_1(k_\rho a)J_1(k_\rho\rho)\frac{k_\rho}{\sqrt{k^2-k_\rho^2}}e^{\mp j\sqrt{k^2-k_\rho^2}\,z}dk_\rho \\ &H(\rho,\phi,z \gtrless 0) = \\ &\quad \frac{I_{in}a}{2}\int_0^\infty J_1(k_\rho a)J_1(k_\rho\rho)\left[\mp u_\rho k_\rho + u_z\frac{k_\rho^2}{\sqrt{k^2-k_\rho^2}}\right]e^{\mp j\sqrt{k^2-k_\rho^2}\,z}dk_\rho, \end{aligned} \tag{1-11}$$

and Eq. (1-8) becomes:

$$E_\phi(r,\theta,\phi) = \frac{ak\eta I_{in}e^{-jkr}}{2r}J_1(ka\sin\theta). \tag{1-12}$$

Eq. (1-12) is exactly the expression (5-54b) in the text, C. A. Balanis, "Antenna Theory," NY, Wiley, 2005, which was obtained by the magnetic vector potential integral method for a filamentary, circular loop of constant current.

Figure 4:
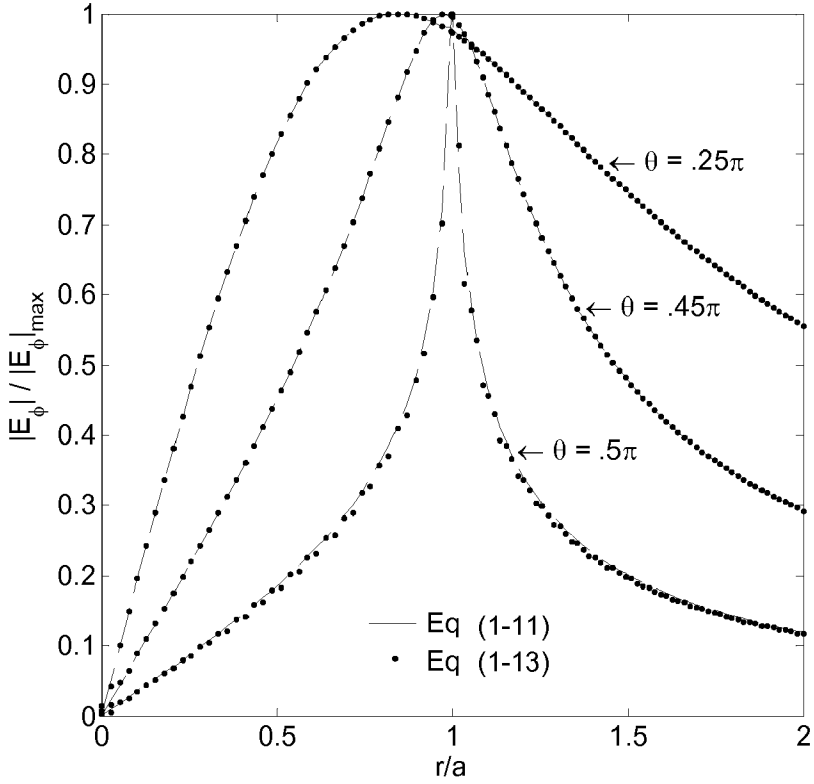
FIG. 4 is a graph showing comparison of equations (1-11) to (1-13) for $a/\lambda=0.1$ using first fifty series terms.

In the paper, L. W. Li, M. S. Leong, et al., "Exact Solutions of Electromagnetic Fields in Both Near and Far Zones Radiated by Thin Circular-Loop Antennas: A General Representation," IEEE Trans. Antennas Propagat., vol. 45, no. 12, pp. 1741-1748, Dec. 1997, an exact expression was derived for the fields produced by a filamentary loop of constant current and arbitrary radius in both near and far-fields. The fields were expressed in terms of a rapidly converging series of the product of several special functions. These expressions are an improvement over those first derived in the article, P. L. Overfelt, "Near Fields of the Constant Current Thin Circular Loop Antenna of Arbitrary Radius," IEEE Trans. Antennas Propagat., vol. 44, no. 2, pp. 166-171, February 1996 because the fields are valid everywhere (including on the loop itself) rather than just the region r>a. From the article, L. W. Li, M. S. Leong, et al., "Exact Solutions of Electromagnetic Fields in Both Near and Far Zones Radiated by Thin Circular-Loop Antennas: A General Representation," IEEE Trans. Antennas Propagat., vol. 45, no. 12, pp. 1741-1748, December 1997, the only non-zero electric field component of a filamentary, constant current loop (rewritten in a slightly more convenient form) is given by:

$$E_\phi(r,\theta,\phi) = -\frac{\eta k^2 a I_{in}}{2}\sum_{n=1}^{\infty}\frac{2n+1}{n(n+1)}\frac{2\sin\left(\frac{n\pi}{2}\right)\Gamma\left(\frac{n}{2}+1\right)}{\sqrt{\pi}\,\Gamma\left(\frac{n+1}{2}\right)}P_n^1(\cos\theta)\cdot\begin{cases} h_n^{(1)}(-kr)j_n(ka), & r>a \\ j_n(kr)h_n^{(1)}(-ka), & r<a, \end{cases} \tag{1-13}$$

where $P_n^1(\xi)$ is the associated Legendre function of the first kind, $h_n^{(1)}(\xi)$, $j_n(\xi)$ are the spherical Hankel and Bessel functions and Γ(ξ) is the gamma function. Numerical integration of (1-11) is in agreement with (1-13) as can be seen in the graph of FIG. 4 (showing a comparison of (1-11) to (1-13) for a/λ=0.1, using first fifty series terms). The number of terms of (1-13) needed for convergence depends on r and a but as few as twenty terms seem to suffice for the near-field region. The graph in FIG. 4 shows that (1-11) and (1-13) are in excellent agreement to within a multiplicative constant. Calculation of the field values for several values of k, η, I showed that they are, in fact, equivalent.

If one wishes to use Eq. (1-13) to calculate the field of the non-filamentary loop of FIG. 3, the fields contributed by small current strips making up the loop are integrated to obtain:

$$E_\phi(r,\theta,\phi) = -\frac{\eta k^2 I_{in}}{2\ln(a_+/a_-)}\sum_{n=1}^{\infty}\frac{2n+1}{n(n+1)}\frac{2\sin\left(\frac{n\pi}{2}\right)\Gamma\left(\frac{n}{2}+1\right)}{\sqrt{\pi}\,\Gamma\left(\frac{n+1}{2}\right)}P_n^1(\cos\theta)\cdot \tag{1-14}$$

$$\begin{cases} h_n^{(1)}(-kr)\int_{a_-}^{a_+} j_n(ka)da, & r>a_+ \\ j_n(kr)\int_{a_-}^{a_+} h_n^{(1)}(-ka)da & r<a_- \\ h_n^{(1)}(-kr)\int_{a_-}^{r} j_n(ka)da + j_n(kr)\int_{r}^{a_+} h_n^{(1)}(-ka)da & a_- \le r \le a_+. \end{cases}$$

§4.1.1.3 Radiated Power and Input Impedance

When sources are present, the complex Maxwell equations, which differ only by an additional impressed magnetic and electric current density term added to the top and bottom equation, respectively, can be algebraically manipulated to obtain the following relationship:

$$\oiint_S E\times H^*\cdot d\mathbf{s} = -\iiint_V (E\cdot J^{t*} + H^*\cdot M^t)dV, \tag{1-15}$$

where V is any volume enclosed by the surface S and $J^t$, $M^t$ are the total (impressed plus induced) electric and magnetic currents. This is known as an expression for the conservation of complex power. (See, e.g., the text, R. F. Harrington, "Time-Harmonic Electromagnetic Fields," NY, Wiley, 2001.) It can be applied to the loop in FIG. 3 to yield an expression for the input impedance in terms of the loop current density and voltage at the driving point. Take as S the smallest surface that encloses the loop plus the independent voltage source of voltage $V_S$ connected to it by a set of infinitely conductive wires across a small radial gap. In linear media, the expressions in the integrand on the right of (1-15) reduces to:

$$E\cdot J^{t*}=\sigma|E|^2-j\omega\epsilon|E|^2+E\cdot J^{i*}$$

$$H^*\cdot M^t=j\omega\mu|H|^2+H^*\cdot M^i, \tag{1-16}$$

where $J^i$, $M^i$ are the impressed electric and magnetic current densities.

Since the volume of the loop under consideration can be made as small as we please, the volume integral of (1-15) is zero over the loop. Inside the source (as represented in the text, R. F. Harrington, "Time-Harmonic Electromagnetic Fields," NY, Wiley, 2001), only the $H^*\cdot M^i$ term of (1-16) contributes to the integral and the right hand term of (1-15), becomes:

$$-\iiint_V H^*\cdot M^i dV = V_s I^*, \tag{1-17}$$

where $I=I_{in}$ must be the total $\phi$ directed loop current by the conservation of charge. The left-hand side of (1-15) is zero over the surface enclosing the source. Evaluating the left-hand side of (1-15) over the part of the surface enclosing the loop by noting that $d\mathbf{s}=u_z ds$ on the $z>0$ side of the loop and $d\mathbf{s}=-u_z ds$ on the $z<0$ side, one obtains:

$$\begin{aligned}\oiint_S E\times H^*\cdot d\mathbf{s} &= \oiint_S E\cdot(H^*\times d\mathbf{s}) = \\ &\iint_{S1} E\cdot(H^*\times u_z)ds - \iint_{S_2} E\cdot(H^*\times u_z)ds = \\ &\iint_{S_1} E\cdot\left(-\frac{J^*}{2}\right)ds - \iint_{S_2} E\cdot\left(\frac{J^*}{2}\right)ds = \\ &-\int_{a_-}^{a_+}\int_0^{2\pi} E\cdot J^*\rho d\phi d\rho,\end{aligned} \tag{1-18}$$

where E is given by the first of Eqs. (1-7) with z=0, and J is given by (1-1). Equating (1-17) with (1-18), and dividing through by $I_{in}$, one obtains an expression for the input impedance of the loop in terms of the field quantities and the total supplied current, which is:

$$Z_{in} = -\frac{1}{|I_{in}|^2}\int_{a_-}^{a_+}\int_0^{2\pi} E\cdot J^*\rho d\phi d\rho. \tag{1-19}$$

Plugging in for E and J and simplifying, Eq. (1-19) takes the form:

$$Z_{in} = \frac{\pi\eta k}{\ln^2(a_+/a_-)}\int_0^\infty \frac{[J_0(a_+k_\rho)-J_0(a_-k_\rho)]^2}{k_\rho\sqrt{k^2-k_\rho^2}}dk_\rho, \tag{1-20}$$

Figure 5:
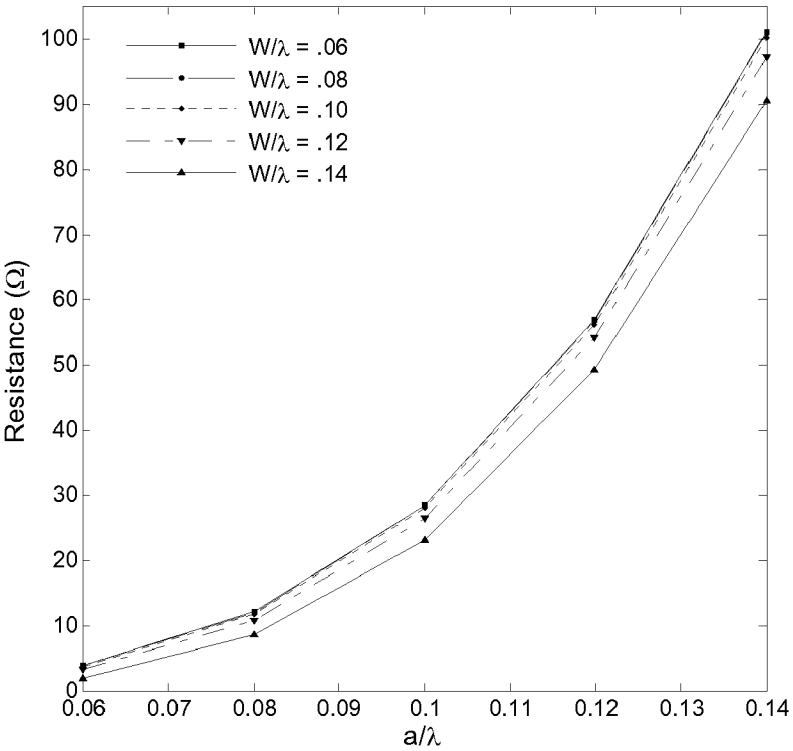
FIG. 5 is a graph of input resistance of a single loop as function of loop radius for several widths.
Figure 6:
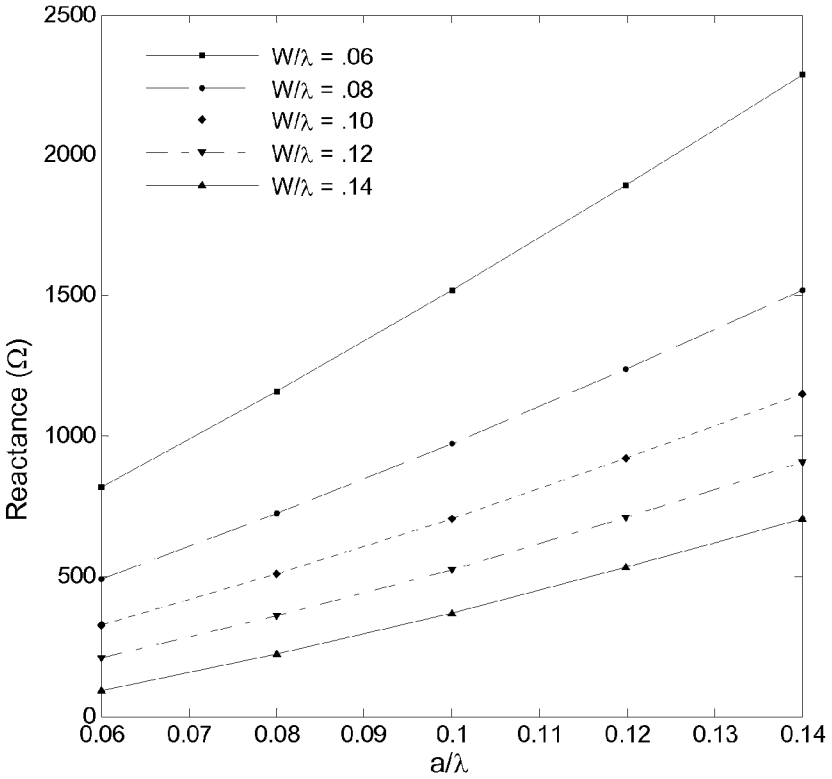
FIG. 6 is a graph of input reactance of single loop as function of loop radius for several widths.
Figure 7:
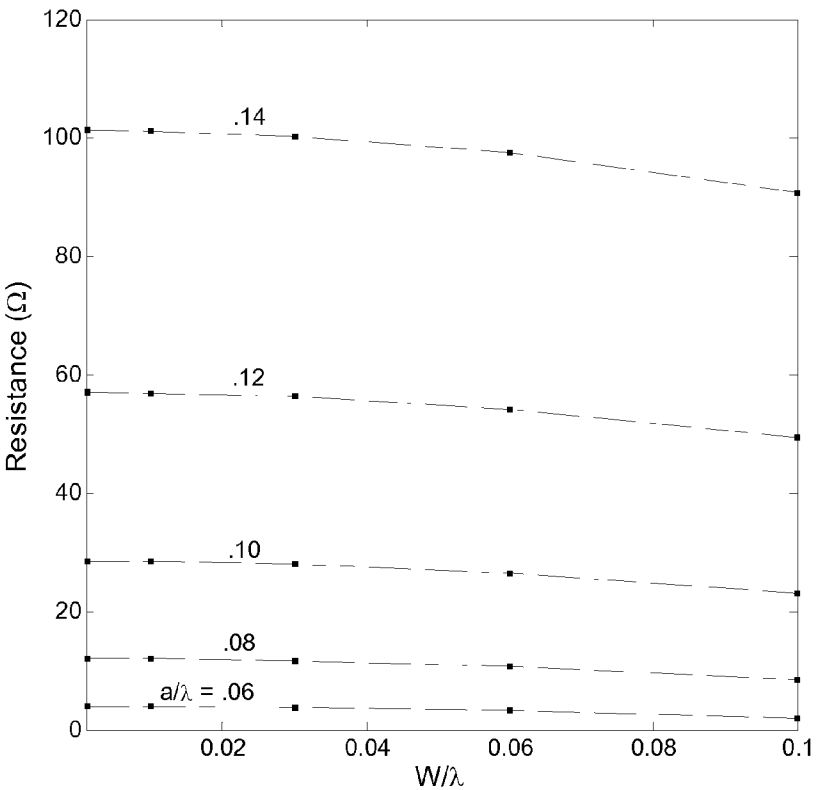
FIG. 7 is a graph of input resistance of single loop as function of loop width for several radii.
Figure 8:
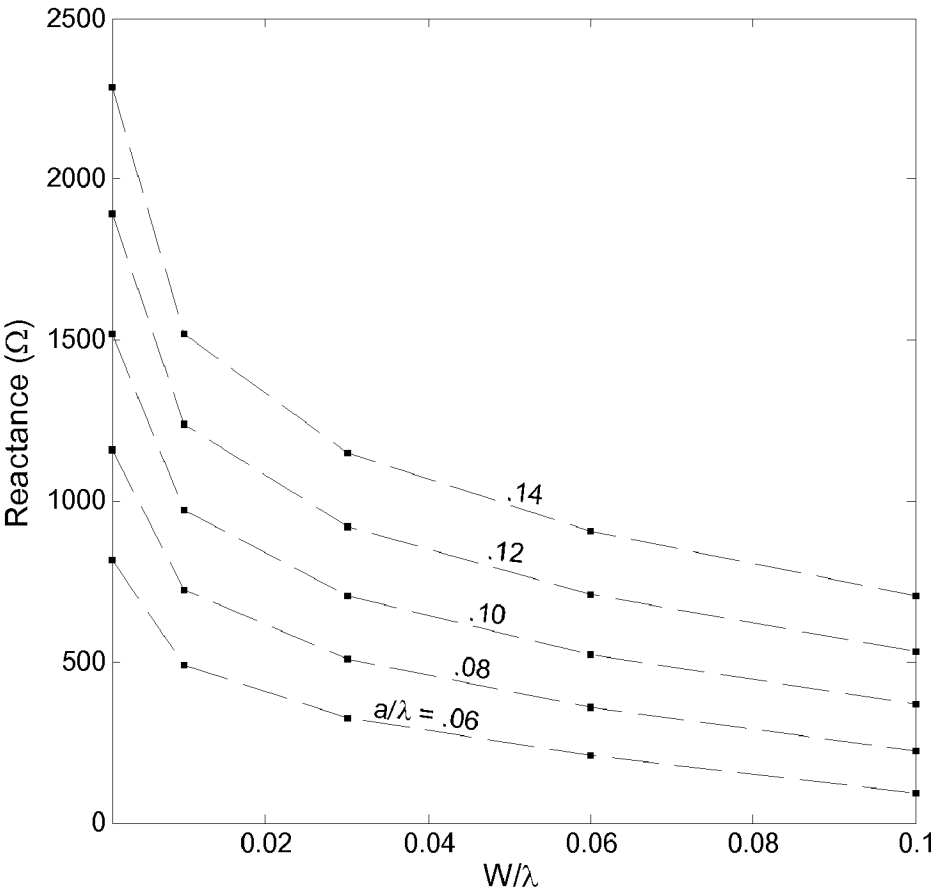
FIG. 8 is a graph of input reactance of single loop as function of loop width for several radii.

Eq. (1-20) can be written in terms of its real and imaginary parts as $Z_{in}=R_{in}+jX_{in}$ where:

$$\begin{aligned}R_{in} &= \frac{\pi\eta k}{\ln^2(a_+/a_-)}\int_0^k [J_0(a_+k_\rho)-J_0(a_-k_\rho)]^2 dk_\rho \\ X_{in} &= \frac{\pi\eta k}{\ln^2(a_+/a_-)}\int_k^\infty \frac{[J_0(a_+k_\rho)-J_0(a_-k_\rho)]^2}{k_\rho\sqrt{k_\rho^2-k^2}}dk_\rho,\end{aligned} \tag{1-21}$$

and the positive square root of the denominator is taken in both cases. The input resistance and reactance as a function of the loop radius for several widths, with both normalized to the wavelength of the medium are graphed in FIGS. 5 and 6, respectively. The same is shown in FIGS. 7 and 8 as a function of loop width for several radii. The graphs are the result of the numerical integration of Eqs. (1-21) for free space or vacuum, where $\eta=\eta_0\approx377\Omega$.

From the graphs it is apparent that the input resistance is strongly dependent on the radius and increases rapidly as the radius is increased. The input reactance also increases as the radius of the loop is increased but approximately an order of magnitude slower than does the input resistance. The input resistance is almost unaffected by loop width for the range of values shown on the graphs. However, the reactance decreases rapidly as the width increases.

It can easily be shown that $R_{in}$ reduces to the classical expression for the radiation resistance, or equivalently, its input resistance in the case of the filamentary, constant current loop. This is done as follows. The approximations (1-9), (1-10) with the additional constraint that $k_\rho a<<1$, for which the small argument approximation to (1-10) yields:

$$-J_1(k_\rho a)Wk_\rho \cong -aWk_\rho^2, \tag{1-22}$$

are used. The expression for the input resistance then simplify to:

$$\begin{aligned}R_{in} &= \frac{\pi k\eta a^4}{4}\int_0^k \frac{k_\rho^3}{\sqrt{k^2-k_\rho^2}}dk_\rho \\ &= \frac{\pi k\eta a^4}{4}\left(-\frac{1}{3}\sqrt{k^2-k_\rho^2}\,(k_\rho^2+2k^2)\Big|_0^k\right) \\ &= \frac{\pi\eta k^4 a^4}{6}.\end{aligned} \tag{1-23}$$

It is also interesting to examine the case of a constant current loop of small width but arbitrary radius. Simplifying for W<<a as above, one obtains for the input impedance of a thin, constant current loop:

$$Z_{in} = \pi k\eta a^2\int_0^\infty J_1^2(k_\rho a)\frac{k_\rho}{\sqrt{k^2-k_\rho^2}}dk_\rho. \tag{1-24}$$

By making the substitution $k_\rho = k \sin \xi$, the real part of (1-24) becomes:

$$R_{in} = \pi k \eta a^2 \int_0^k J_1^2(k_\rho a) \frac{k_\rho}{\sqrt{k^2 - k_\rho^2}} dk_\rho = \pi k^2 \eta a^2 \int_0^{\pi/2} J_1^2(ka\sin\xi)\sin\xi d\xi, \quad (1\text{-}25)$$

which is exactly the expression derived in the text, C. A. Balanis, "Antenna Theory," NY, Wiley, 2005. As pointed out in the article, S. V. Savoy, "An Efficient Solution of a Class of Integrals Arising in Antenna Theory," IEEE Antennas Propagat. Mag., vol. 44, no. 5, pp. 98-101, October 2002 (where the text, G. N. Watson, "A Treatise on the Theory of Bessel Functions," Cambridge University Press, London, 1922 was used), Eq. (1-25) can be expressed in terms of an infinite series of Bessel functions as:

$$R_{in} = 2\pi\eta k a \sum_{m=0}^{\infty} J_{2m+3}(2ka). \quad (1\text{-}26)$$

A plot of (1-25) versus loop circumference, first made available in the article, D. Foster, "Loop antennas with uniform current," Proc. IRE, vol. 32, pp. 603-607, October 1944, where the exact series representation of (1-25) was not known, is confirmed in the article, S. V. Savoy, "An Efficient Solution of a Class of Integrals Arising in Antenna Theory," IEEE Antennas Propagat. Mag., vol. 44, no. 5, pp. 98-101, October 2002 by evaluating the truncated series of (1-26).

Although the radiation resistance (1-25) is exactly that obtained in the text, C. A. Balanis, "Antenna Theory," NY, Wiley, 2005, it is important to note the difference in derivation. In the text, C. A. Balanis, "Antenna Theory," NY, Wiley, 2005, the far fields of an infinitesimally thin, or filamentary, constant current loop are found via integration of the magnetic vector potential with the help of the usual far-field approximations. The total radiated power is then found by integrating the radiated power density over a sphere, and divided by the square of the magnitude of the input current to obtain the input resistance.

§4.1.2 Discussion of Coaxial Arrays of Circular Current Loops

This section focuses on the properties of arrays consisting of loops of the type analyzed above, arranged coaxially, with their planes parallel. Expressions are obtained for the far-fields, in terms of the previously derived field expression for the single loop. The mutual impedance is also determined in terms of the field quantities and is used to determine the impedance matrix of the array, from which the currents on the loops can be found given the loop voltages.

§4.1.2.1 Electric and Magnetic Fields

Figure 9:
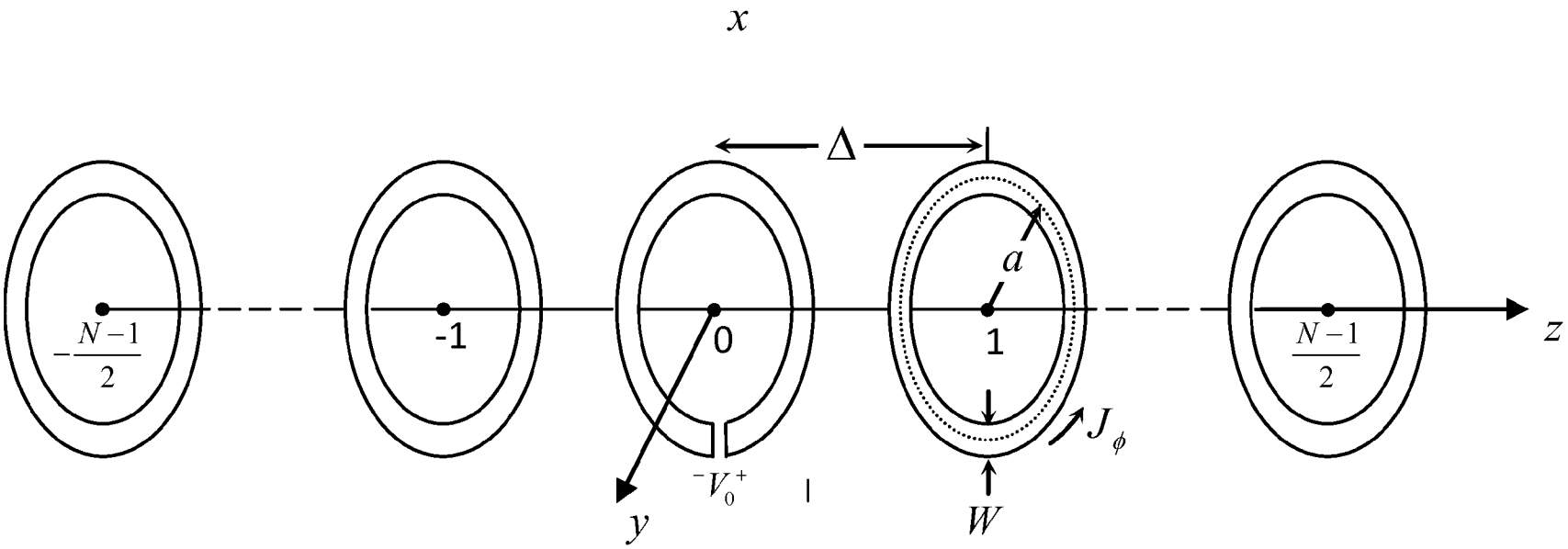
FIG. 9 illustrates a geometry of coaxial, odd length, circular loop array excited by center element.

For an array consisting of and odd number N of coaxial, uniformly spaced loops of different widths and radii, like the one shown in FIG. 9, the electric and magnetic fields can be found by adding the fields due to each loop alone. We are primarily interested in the radiation zone fields, which for an individual loop are given by (1-8). By linear superposition of the fields due to the individual loops, the only non-zero component of the electric field produced by the array is:

$$E_\phi(r,\theta,\phi) = \sum_{n=-\frac{N-1}{2}}^{\frac{N-1}{2}} E_{\phi n}(r - n\Delta\cos\theta, \theta, \phi) = \frac{\eta}{2r\sin\theta} e^{-jkr} \sum_{n=-\frac{N-1}{2}}^{\frac{N-1}{2}} \left\{ \frac{I_n e^{jkn\Delta\cos\theta}}{\ln(a_{n+}/a_{n-})} [J_0(k\sin\theta a_{n+}) + J_0(k\sin\theta a_{n-})] \right\}, \quad (2\text{-}1)$$

where $a_{n-}$, $a_+$ are the inner and outer radii of the $n^{th}$ loop.

The radiation intensity corresponding to (2-1) is:

$$U_{rad}(\theta,\phi) = \frac{|E_\phi(r,\theta,\phi)|^2}{\eta} r^2 = \frac{\eta}{4\sin^2\theta} \left| \sum_{n=-\frac{N-1}{2}}^{\frac{N-1}{2}} \left\{ \frac{I_n e^{jkn\Delta\cos\theta}}{\ln(a_{n+}/a_{n-})} \left[ \begin{matrix} J_0(k\sin\theta a_{n+}) - \\ J_0(k\sin\theta a_{n-}) \end{matrix} \right] \right\} \right|^2. \quad (2\text{-}2)$$

The input resistance of the array must be equal to the total radiated power divided by the square of the current magnitude, which in equation form is:

$$R_r = \frac{1}{|I_0|^2} \int_0^{2\pi} \int_0^{\pi} U_{rad}(\theta,\phi)\sin\theta d\theta d\phi = \frac{\pi\eta}{2|I_0|^2} \int_0^{\pi} \frac{1}{\sin\theta} \left| \sum_{n=-\frac{N-1}{2}}^{\frac{N-1}{2}} \left\{ \frac{I_n e^{jkn\Delta\cos\theta}}{\ln(a_{n+}/a_{n-})} \left[ \begin{matrix} J_0(k\sin\theta a_{n+}) - \\ J_0(k\sin\theta a_{n-}) \end{matrix} \right] \right\} \right|^2 d\theta. \quad (2\text{-}3)$$

For the case of the array of identical loops, Eqs. (2-1)-(2-3) take the simplified forms:

$$E_\phi(r,\theta,\phi) = \frac{\eta}{2r\ln(a_+/a_-)} \frac{[J_0(k\sin\theta a_+) - J_0(k\sin\theta a_-)]}{\sin\theta} e^{-jkr} \sum_{n=-\frac{N-1}{2}}^{\frac{N-1}{2}} I_n e^{jkn\Delta\cos\theta} = \frac{\eta}{2r\ln(a_+/a_-)} \frac{[J_0(k\sin\theta a_+) - J_0(k\sin\theta a_-)]}{\sin\theta} e^{-jkr} \left[ I_0 + 2\sum_{n=1}^{\frac{N-1}{2}} I_n \cos(kn\Delta\cos\theta) \right], \quad (2\text{-}4)$$

$$U_{rad}(\theta,\phi) = \frac{\eta}{4\ln^2(a_+/a_-)} \frac{[J_0(k\sin\theta a_+) - J_0(k\sin\theta a_-)]^2}{\sin^2\theta} \left| I_0 + 2\sum_{n=1}^{\frac{N-1}{2}} I_n \cos(kn\Delta\cos\theta) \right|^2, \quad (2\text{-}5)$$

-continued $$R_r = \frac{\pi\eta}{2|I_0|^2\ln^2(a_+/a_-)} \int_0^{\pi} \frac{[J_0(k\sin\theta a_+) - J_0(k\sin\theta a_-)]^2}{\sin\theta} \left| I_0 + 2\sum_{n=1}^{\frac{N-1}{2}} I_n\cos(kn\Delta\cos\theta) \right|^2 d\theta. \quad (2\text{-}6)$$

Eqs. (2-4)-(2-6) can be further simplified when W<<a. Using the approximations of (1-9), (1-10) we find that, under this condition, $$E_\phi(r,\theta,\phi) = \frac{ak\eta}{2r} J_1(ka\sin\theta)e^{-jkr}\left[I_0 + 2\sum_{n=1}^{\frac{N-1}{2}} I_n\cos(kn\Delta\cos\theta)\right], \quad (2\text{-}7)$$

$$U_{rad}(\theta,\phi) = \frac{a^2k^2\eta}{4} J_1^2(ka\sin\theta)\left|I_0 + 2\sum_{n=1}^{\frac{N-1}{2}} I_n\cos(kn\Delta\cos\theta)\right|^2, \quad (2\text{-}8)$$

$$R_r = \frac{\pi a^2k^2\eta}{2|I_0|^2}\int_0^{\pi}\left\{J_1^2(ka\sin\theta)\left|I_0 + 2\sum_{n=1}^{\frac{N-1}{2}} I_n\cos(kn\Delta\cos\theta)\right|^2 \sin\theta\right\} d\theta. \quad (2\text{-}9)$$

The evaluation of any of the above expressions would obviously require knowledge of the loop currents. The determination of loop currents is considered in the next two sections, by formulating an expression for the mutual impedance between a pair of loops and showing how the currents can be expressed in terms of an impedance matrix (whose elements are the mutual impedances between all the pairs of loops in the array) and the driving gap voltages of each loop in the array.

§4.1.2.2 Mutual Impedance

Figure 10:
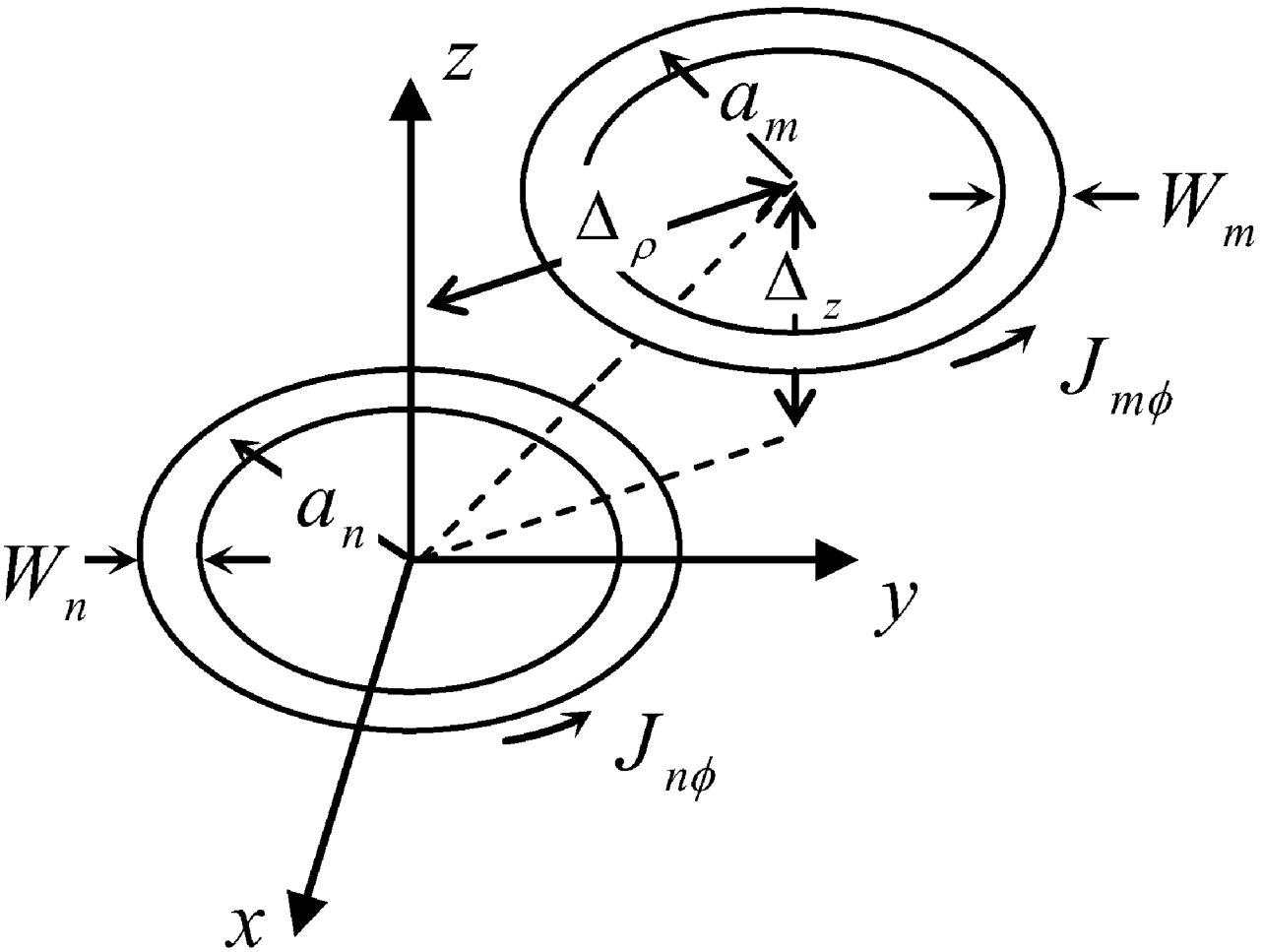
FIG. 10 illustrates a geometry for formulation of mutual impedance between two loops.
Figure 11:
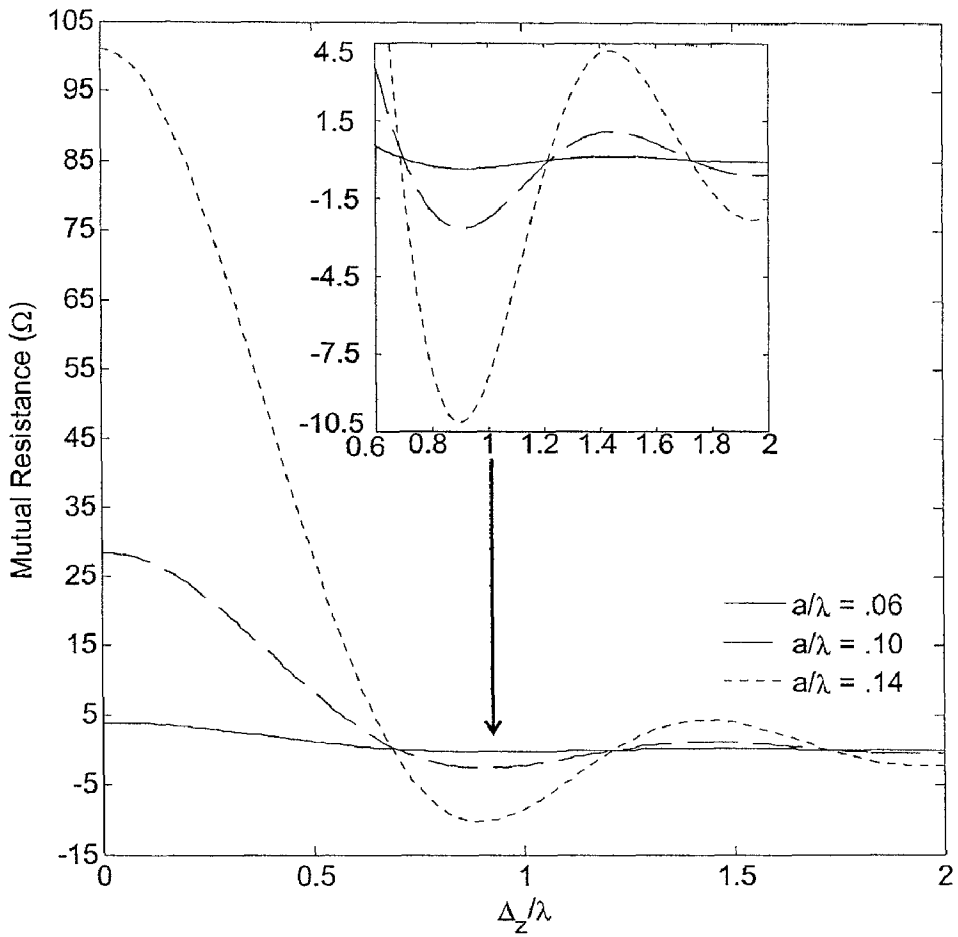
FIG. 11 is a graph of mutual resistance between two coaxial loops as function of axial separation for several radii, with $W/\lambda=10^{-2}$.
Figure 12:
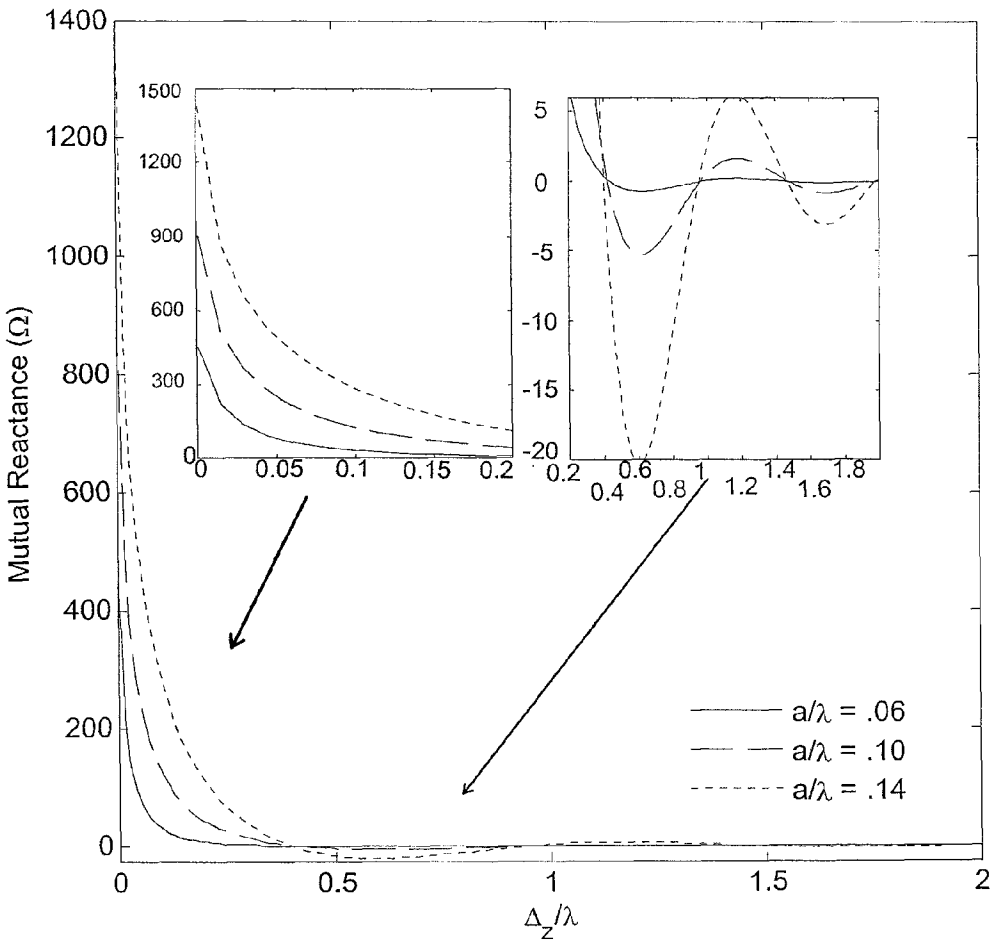
FIG. 12 is a graph of mutual reactance between two coaxial loops as function of axial separation for several radii, with $W/\lambda=10^{-2}$.
Figure 13:
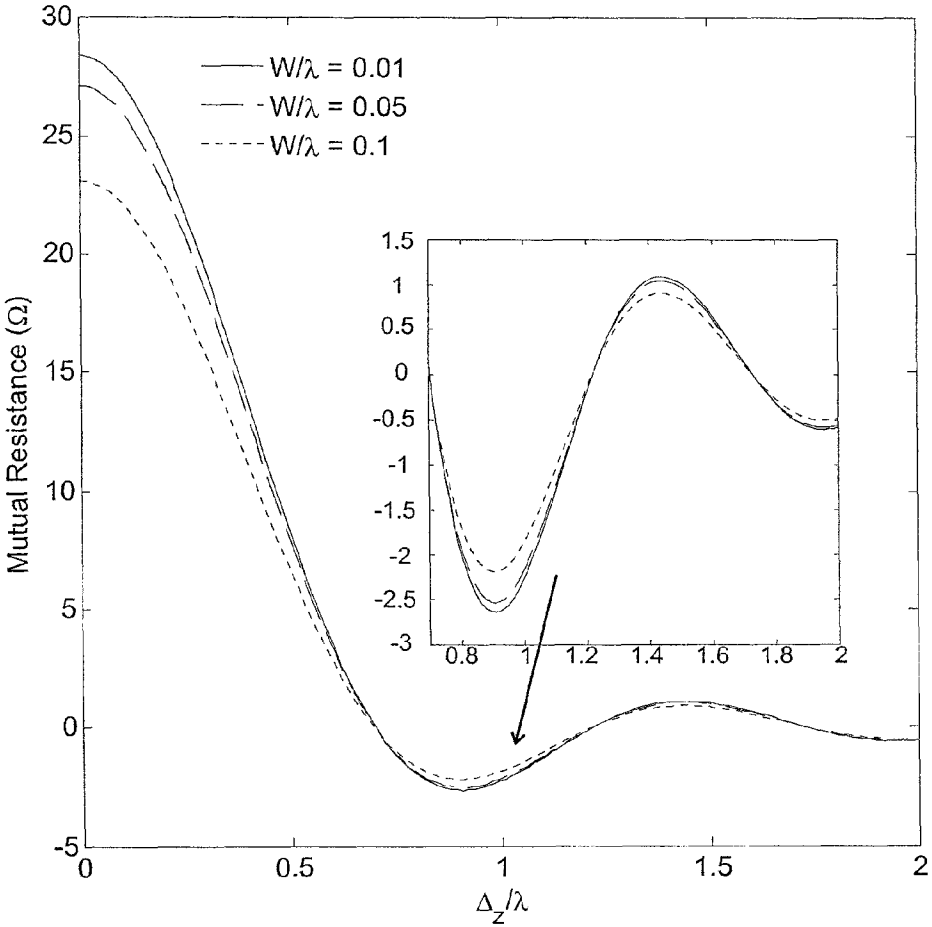
FIG. 13 is a graph of mutual resistance between two coaxial loops as function of axial separation for several widths, with $a/\lambda=10^{-1}$.
Figure 14:
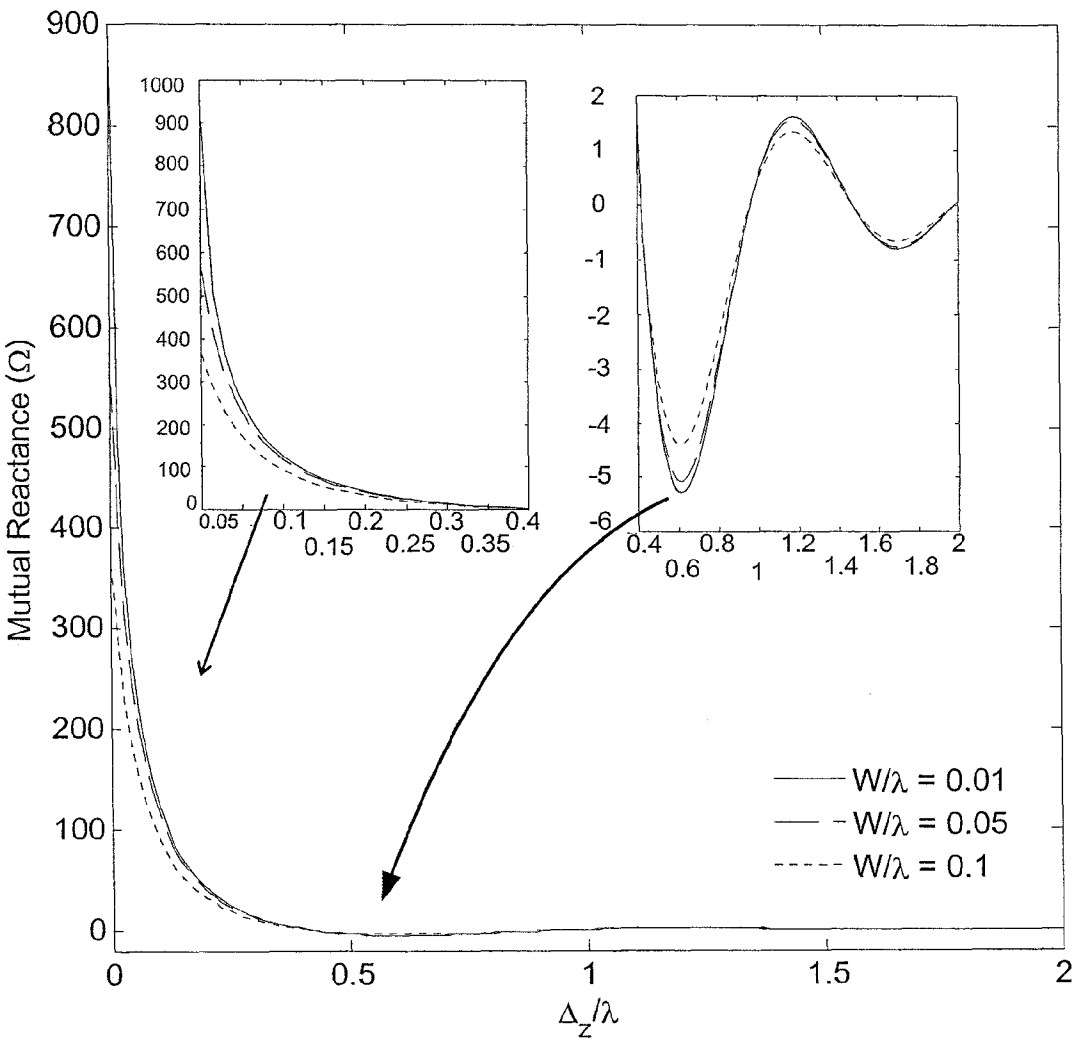
FIG. 14 is a graph of mutual reactance between two coaxial loops as function of axial separation for several widths, with $a/\lambda=10^{-1}$.

As with self-impedance, expressions for the mutual impedance between two loops in terms of field quantities can be derived by applying the complex power conservation equation to a region containing one of the two loops and its source, while considering the fields produced by the other loop and its source. The geometry of two loops is shown in FIG. 10. It is assumed that the current distributions are the same on both loops and voltage sources n and m of voltages $V_n$ and $V_m$ are connected to loop n and m, respectively. Applying the complex power conservation Eq. (1-15) to a surface S just bounding the loop n (which has center at the origin) and its source, and reasoning as above, we obtain the following relation:

$$-\int_{a_-}^{a_+}\int_0^{2\pi} E\cdot J^*\rho d\phi d\rho = -\int\int_V\int H^*\cdot M^i dV. \quad (2\text{-}10)$$

Since a voltage source is connected to the second loop (loop m) the fields E, H over the area of loop n will consist of a linear combination of fields due to both sources or, in equation form, we have that:

$$E = E_{nn} + E_{nm}$$

$$H = H_{nm} + H_{nm}, \quad (2\text{-}11)$$

where $E_{nm}$ is the field due to loop n in the absence of loop m and $E_{nm}$ is the field due to loop m in the absence of loop n. Substituting (2-11) into (2-10) and integrating the right side, using the source representations of the text, R. F. Harrington, "Time-Harmonic Electromagnetic Fields," NY, Wiley, 2001, we obtain:

$$-\int_{a_-}^{a_+}\int_0^{2\pi} E_{nn}\cdot J^*\rho d\phi d\rho - \int_{a_-}^{a_+}\int_0^{2\pi} E_{nm}\cdot J^*\rho d\phi d\rho = I_{mm}^* V_n + I_{nm}^* V_n, \quad (2\text{-}12)$$

where $I_{mm}$, $I_{nm}$ are the total currents excited on loop n by voltage source m and voltage source n, respectively. Dividing (2-12) by $I_{nm}I^*_{mm}$ and comparing with (1-19) we obtain:

$$Z_{nm} = \frac{V_n}{I_m} = -\frac{1}{I_{nm}^* I_m}\int_{a_-}^{a_+}\int_0^{2\pi} E_{nm}\cdot J^*\rho d\phi d\rho, \quad (2\text{-}13)$$

which is an expression for the mutual impedance between two loops in terms of their fields and current densities. Substituting the field and current density expressions derived earlier into (2-13), the mutual impedance of loop n on m is given by:

$$Z_{mn} = \pi\eta k\int_0^{\infty} \frac{[J_0(a_{m+}k_\rho) - J_0(a_{m-}k_\rho)]}{\ln(a_{m+}/a_{m-})\ln(a_{n+}/a_{n-})} \frac{[J_0(a_{n+}k_\rho) - J_0(a_{n-}k_\rho)]}{k_\rho\sqrt{k^2 - k_\rho^2}} J_0(k_\rho\Delta_\rho) e^{j\Delta_s\sqrt{k^2-k_\rho^2}} dk_\rho, \quad (2\text{-}14)$$

where $\Delta_\rho$, $\Delta_z$ are, respectively, the separation between the loop centers along the ρ and z directions. For the case of identical, coaxial loops, the above expression takes the simplified form:

$$Z_{mn} = \frac{\pi\eta k}{\ln(a_+/a_-)}\int_0^{\infty} \frac{[J_0(a_+k_\rho) - J_0(a_-k_\rho)]^2}{k_\rho\sqrt{k^2 - k_\rho^2}} e^{j\Delta_z\sqrt{k^2-k_\rho^2}} dk_\rho. \quad (2\text{-}14)$$

The input resistance and reactance as a function of the loop radius and width normalized to the wavelength of the medium are plotted in FIGS. 11-14, respectively. The graphs are the result of the numerical integration of Eq. (2-15) for free space, where $\eta = \eta_0 \approx 377\ \Omega$.

§4.1.3 Design Factors

From the graphs, it is apparent that both the mutual resistance and mutual reactance decrease very rapidly as the loop spacing relative to wavelength is increased. For closely spaced loops, such that $\Delta_z/\lambda < 0.4$, the reactance is a strong function of the radius of the loops and increasing the radius dramatically increases the mutual reactance. Changing the width has a much weaker effect on the reactance than the radius, and the reactance decreases as the width increases. As for the mutual resistance: it is almost unaffected by changes in the width of the loops but has a strong dependency on the radius. The change in mutual resistance is positive for a positive change in the radius of the loops and negative for a positive change in the width of the loops.

As should be appreciated from the foregoing, each ring element 110 in FIG. 1 operates as a small loop antenna element that produces electromagnetic fields near itself, as well as at far-away distances, through radiation. Normally, when there are many elements in the array structure, and only the input element is excited, the currents on other elements away from the input element will gradually reduce in amplitude, eventually leading to a negligible current at the far end. This is not desired.

Fortunately, a special wave-guidance condition can be achieved such that the current in ring elements 110 far away from the input do not actually reduce in magnitude, but rather remain a constant (ideally). This effect would be independent of the length of the total structure (ideally). The special wave-guidance condition is summarized below.

Under the special wave-guidance condition, $\beta$ denotes the propagation constant (which is inversely proportional to signal velocity) and the phase difference between the two neighboring ring elements 110 would be $\beta\Delta$ (where $\Delta$ is the distance of separation 120 between two neighboring ring elements 110. Ideally, the waveguide 100 is assumed to be infinite in length, consisting of infinite number of ring elements 110. The current in each ring element 110 induces electromagnetic fields, which produces a voltage across (1) its own input terminals (through near-field effects of the current), and (2) the input terminals of all other elements (through far-field radiation effects). Thus, the total voltage across any particular ring element 110 is the sum of the voltage produced by its own fields and those voltages induced by all other ring elements.

With proper design, the total voltage thus produced can be shown to be +90 degrees out of phase with respect to its own current, with no in-phase component. This would mean that the total structure would effectively appear as a pure inductance (L) when seen across the input terminals of any ring element 110. This is in distinct contrast to the voltage produced by the current on a single ring element 110, which always has a component that is in phase with the current, contributed by a non-zero radiation generated from the ring element 110.

The foregoing special condition has significant fundamental implications. More specifically, if a capacitance (C) is connected across the terminals of each ring element 110, and if the capacitive reactance is equal and opposite to that of the equivalent inductance (L) the situation may be viewed as a "global resonance" condition. Thus, if a capacitance of the capacitor portion of a ring element 110 has a capacitive reactance which is equal and opposite to an effective inductance L seen at the input of each conducting ring element 110, while they are all operating together, this can be referred to as a "global resonance" condition. Under such a condition, any small field by an input source can excite this "global resonance mode" in a self-sustainable way, which would carry the signal power with no loss to any far-away distance (ideally). The mode of signal transmission using this global resonance condition is referred to as the "wave-guide mode."

The design of the capacitance C is based on the level of the effective inductance L seen at the ring input. Different values of propagation constant $\beta$, element separation $\Delta$, and ring element width W and radius "a", would correspond to different values of L, and accordingly different values of design capacitance C to satisfy the wave-guidance condition. Recall that FIG. 2 shows parameters of an individual ring element 200. A narrow or thin ring (smaller W) and/or a larger radius "a" would cause larger inductive fields, leading to the design of a smaller capacitance C. Conversely, a wider or thicker ring (larger W) and/or a smaller radius "a" would cause smaller inductive fields, leading to the design of a larger capacitance C.

As explained, establishing the global resonance condition is possible only when the total infinite length and ring element waveguide structure, as seen at the input of each ring element, would produce a purely inductive impedance, without any resistive or in-phase part. This is possible under three specific design conditions: (1) each ring element is sufficiently small and/or narrow compared to the signal wavelength $\lambda_0$ in the free space; (2) the propagation constant $\beta$ is greater than the wave number $k_0=2\pi/\lambda_0$; and (3) the element separation $\Delta$ is less than a half of the signal's wavelength. More specifically, having each ring element sufficiently small ensures the inductive nature of the input impedance (as opposed to capacitive). The other two conditions ensure that the total fields of the array are strictly evanescent in nature, when no power escapes in the lateral direction from the structure in the form of radiation. Otherwise, a resistive impedance would be produced at each ring input, thus violating the required global resonance condition described above. Having the propagation constant $\beta$ larger than the wave number in the free space, ensures that the primary array fields (called the dominant Floquet mode of the array) are evanescent in nature. In addition, having the element separation less than a half wavelength ensures that there is no grating effect of the array (which means all secondary array fields (higher order Floquet modes of the array) are also evanescent in nature). Accordingly, satisfying the above two conditions (2) and (3) ensures that all fields are evanescent in nature.

In practice, however, the free-space waveguide 100 would be finite in length (with a finite number of ring elements 110), and the conductor in each ring element 110 would have some non-zero amount of loss. In this case, the global resonance mode discussed above would deviate from the ideal situation. There would be some radiation loss due to the truncations or discontinuities at the source and load ends, and some ohmic loss in the conducting body of the ring elements. The discontinuity loss may be minimized by design of efficient transition devices (e.g., matching circuits) to connect the excitation source, with proper impedance matching. The ohmic loss may be reduced by designing the loop elements with thicker or wider loops, and/or by using good conducting material.

Although undesirable, the discontinuity losses are not a fundamental concern for the overall operation of the free-space waveguide system since this loss is a "one-time" loss, independent of the total length of the free-space waveguide 100. That is, once the discontinuity losses are excluded, the rest of the power passes through the free-space waveguide system without any further leakage. A free-space waveguide system with some discontinuity losses at the ends is analogous to having a water pipe, with imperfect joints at its two ends. The discontinuity loss in the free-space waveguide system is like any water leakage at the input and output joints. The joint problem can be addressed by designing a good joining arrangement at input and output ends. Although this problem is important, it is independent of the quality and usability of a good pipe itself. That is, a good pipe is still usable, even if the joints have some reasonable loss.

On the other hand, an ideal quality of the pipe, without any leakage along its length, is analogous to the ideal waveguide condition (established through the global resonance effects) discussed above, without any distributed radiation along the waveguide. That is, ideal global resonance condition ensures that there is no radiation leakage along the guide. However, any ohmic loss in the conductors of the ring would result in some non-zero amount of power dissipation in practical designs. Such ohmic losses are analogous to having small, though acceptable, holes along the length of the water pipe. This determines the usability and the maximum length of the pipe before an unacceptable amount of water is lost. The ohmic loss can usually be kept at a practically low level, making the system useful over significantly large physical distances.

§4.2 Exemplary Systems

Figure 15:
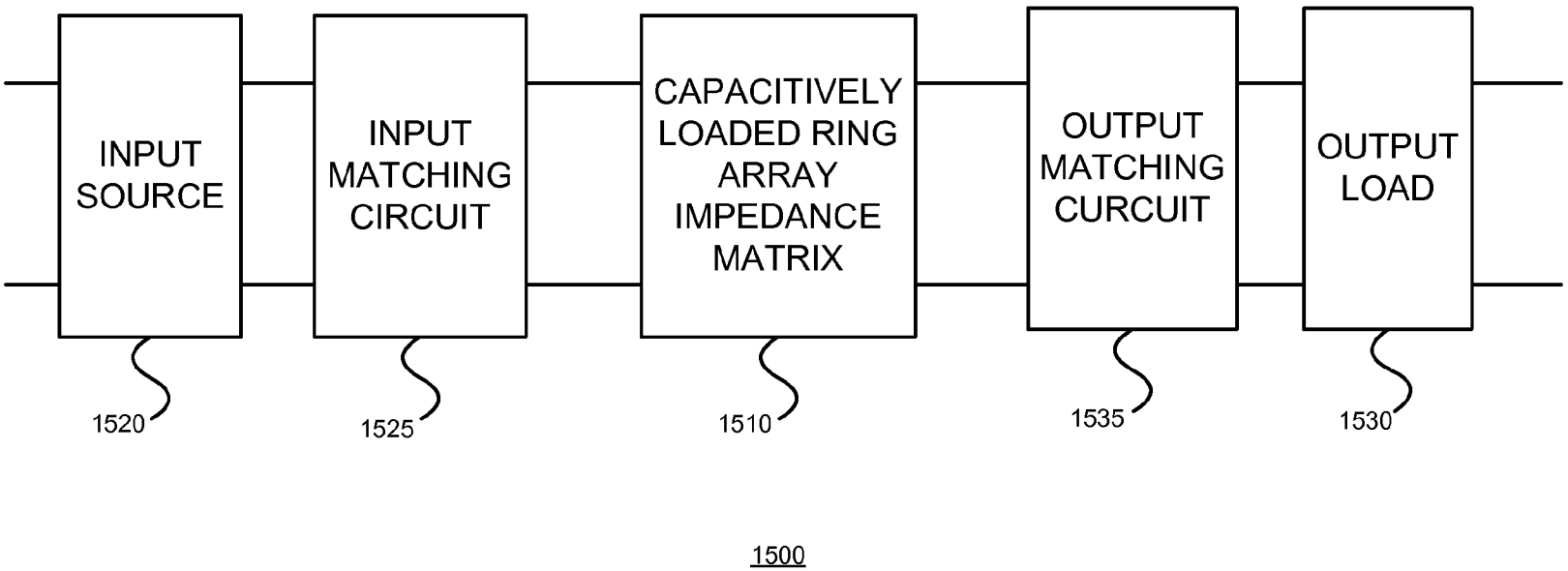
FIG. 15 is a block diagram illustrating the use of matching circuits for coupling an exemplary free-space waveguide with an input signal source and an output load (sink).
Figure 16:
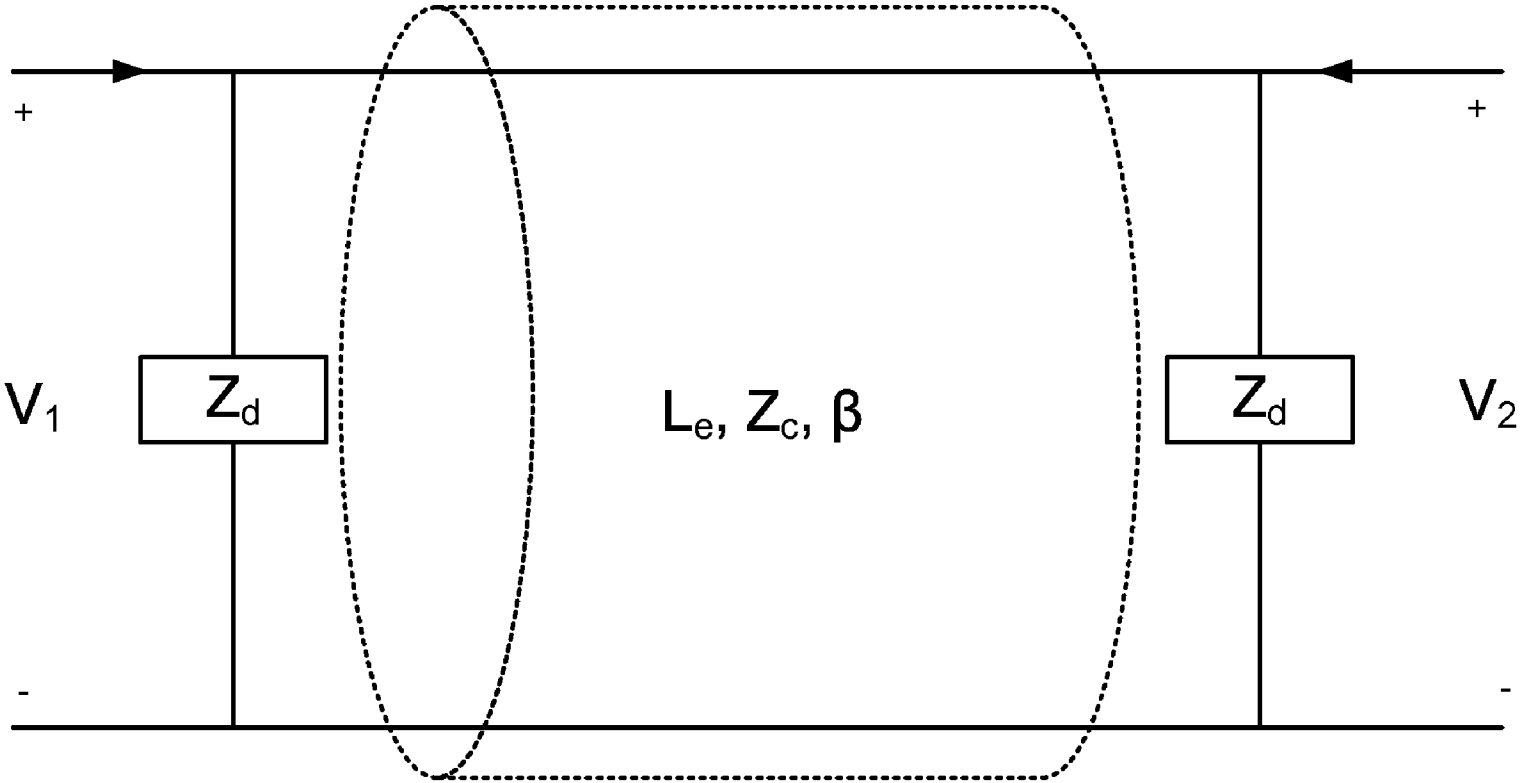
FIG. 16 illustrates an equivalent transmission line model for a length of a conducting ring element array.
Figure 17:
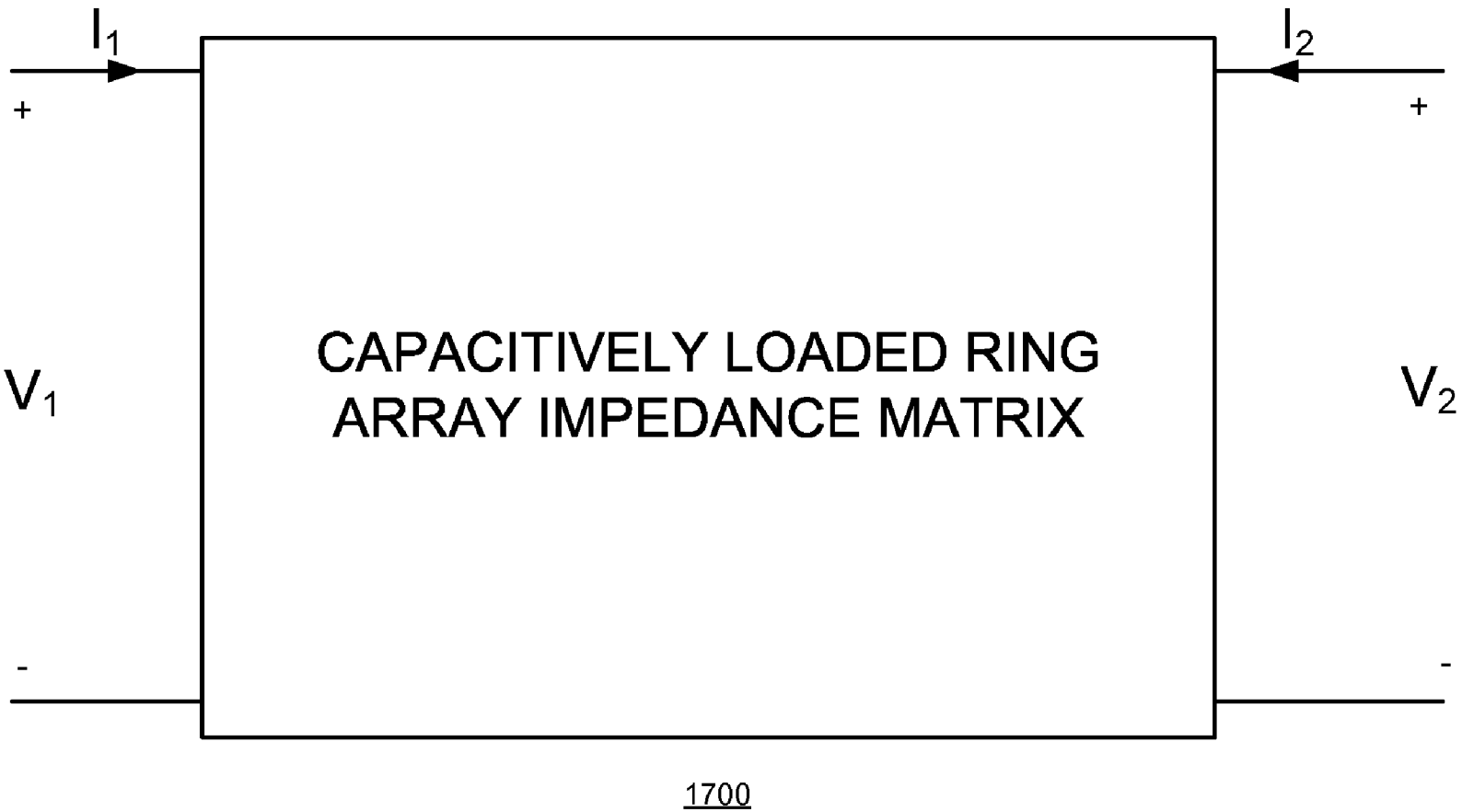
FIG. 17 illustrates an equivalent two-port circuit model of a conducting ring element array.

FIG. 15 is a block diagram 1500 illustrating the use of matching circuits 1525 and 1535 for coupling an exemplary free-space waveguide 1510 with an input signal source 1520 and an output load (sink, or receiver) 1530, respectively. As explained, the problem of input/output excitation and matching is independent of the design or the waveguide arrangement itself. However, to best exploit the free-space waveguide 1510, a reasonable design of the input and output coupling arrangements would be useful. Guidelines for the design of the input and output matching circuits 1525 and 1535, respectively, are now discussed. FIG. 16 shows an equivalent circuit model 1610 for a finite-length, free-space waveguide. The free-space waveguide is modeled as an equivalent transmission line, with a propagation constant $\beta$, and characteristic impedance $Z_c$. The discontinuity effects at the two ends are modeled by an impedance parameter $Z_d$, referred to as the discontinuity impedance. The "effective length" of the transmission line is different from the physical length of the waveguide. Suitable correction lengths may be used to account for the end effects. With the equivalent circuit 1610 for a finite-length free-space waveguide properly defined, the entire circuit may also be treated as a two-port circuit, with it impedance matrix [Z] properly defined in terms of the circuit parameters, as shown in FIG. 17. Using the impedance matrix or the circuit parameters, one may design suitable input and output matching circuits 1525 and 1535, respectively, for given source and load parameters, using basic circuit theory. Proper optimization of the matching circuit can minimize any radiation caused by the discontinuity. Further improvement may be possible by design of radiation shields or transition devices.

§4.3 Exemplary Methods

Figure 18:
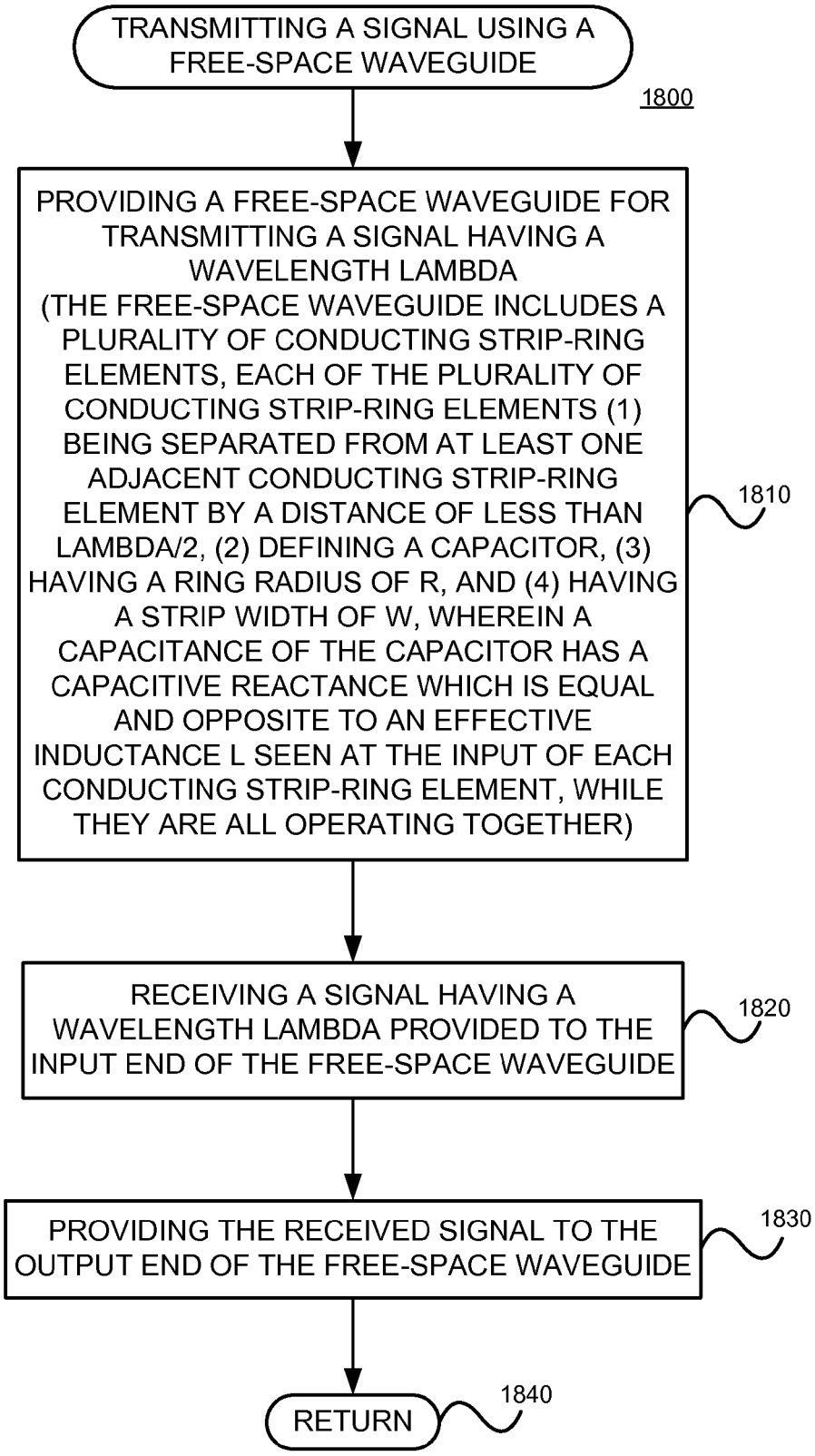
FIG. 18 is a flow diagram of an exemplary method for transmitting a signal using an exemplary free-space waveguide in a manner consistent with the present invention.

FIG. 18 is a flow diagram of an exemplary method 1800 for transmitting a signal using an exemplary free-space waveguide in a manner consistent with the present invention. A free-space waveguide is provided for transmitting a signal having a wavelength lambda. (Block 1810). The free-space waveguide includes a plurality of conducting ring elements, each of the plurality of conducting ring elements (1) being separated from at least one adjacent conducting ring element by a distance of less than lambda/2, (2) including a capacitor portion, (3) having a ring radius of "a" and (4) having a strip width of W, wherein a capacitance of the capacitor portion has a capacitive reactance which is equal and opposite to an effective inductance L seen at the input of each conducting ring element, while they are all operating together. A signal having a wavelength lambda provided to the input end of the free-space waveguide is received. (Block 1820) The signal is then transmitted from the input end of the free-space waveguide to the output end of the free-space waveguide, where it is provided. (Block 1830) The method 1800 is then left. (Node 1840)

§4.4 Refinements, Extensions and Alternatives

The ring elements can be made from any conducing material such as, for example, copper, aluminum, gold, etc. A superior conducting material is desirable in order to reduce the material loss along the cable, allowing signal propagation over longer distance. The ring elements may be made from material having a circular cross-section (e.g., wire), a rectangular cross-section (e.g., thin tape), a regular polygon cross-section, etc.

Figure 19:
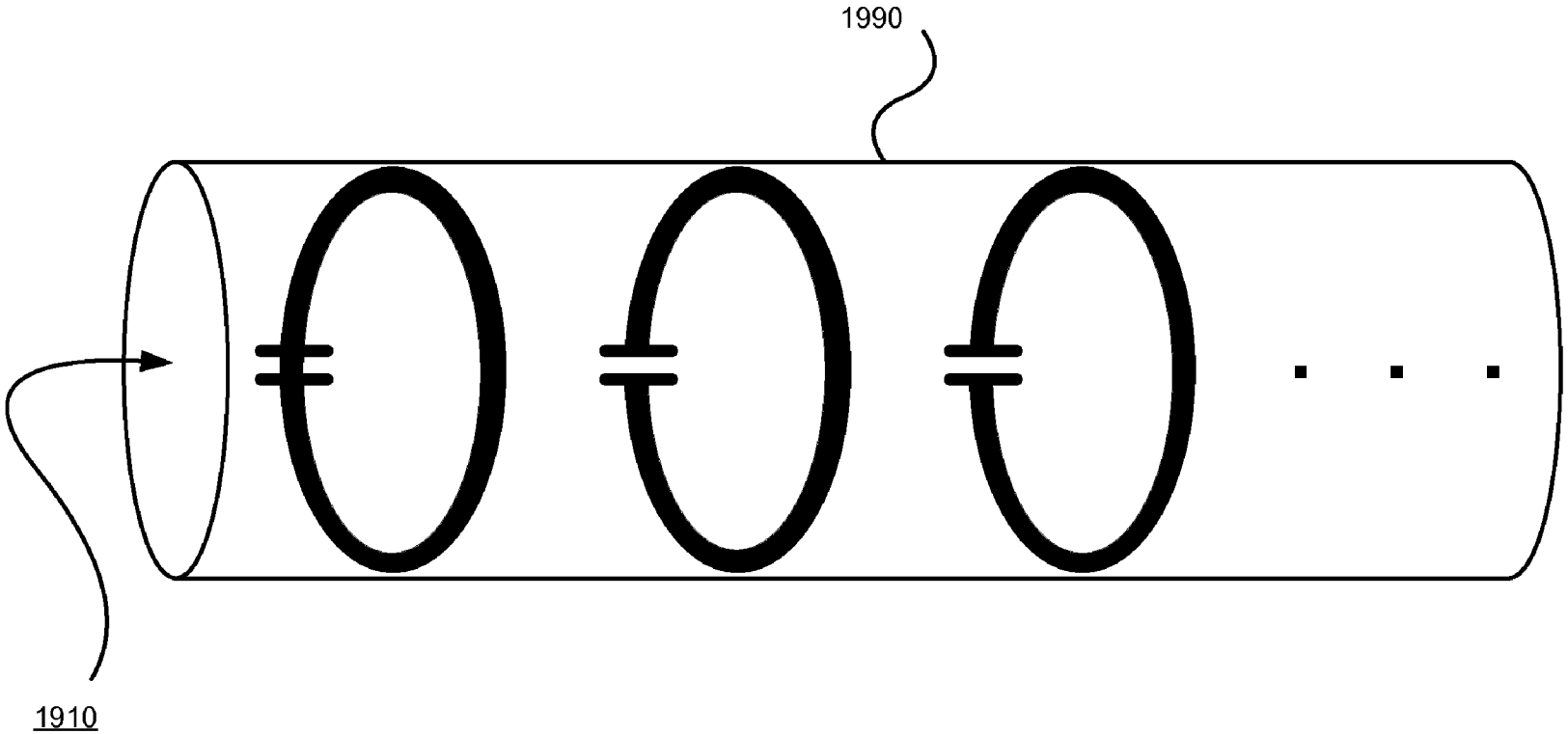
FIGS. 19-21 illustrate the arrangement of ring elements of a free-space waveguide by non-conducting components.
Figure 20:
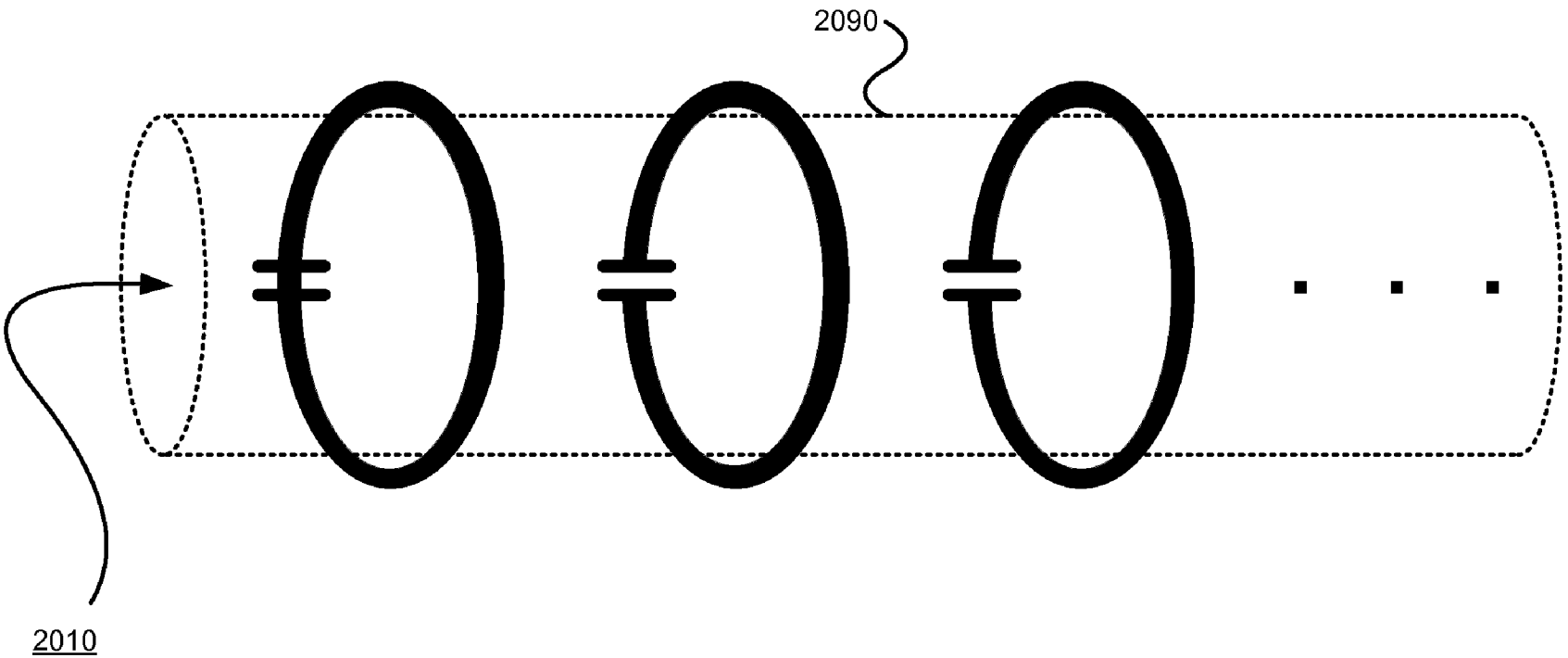
Figure 21:
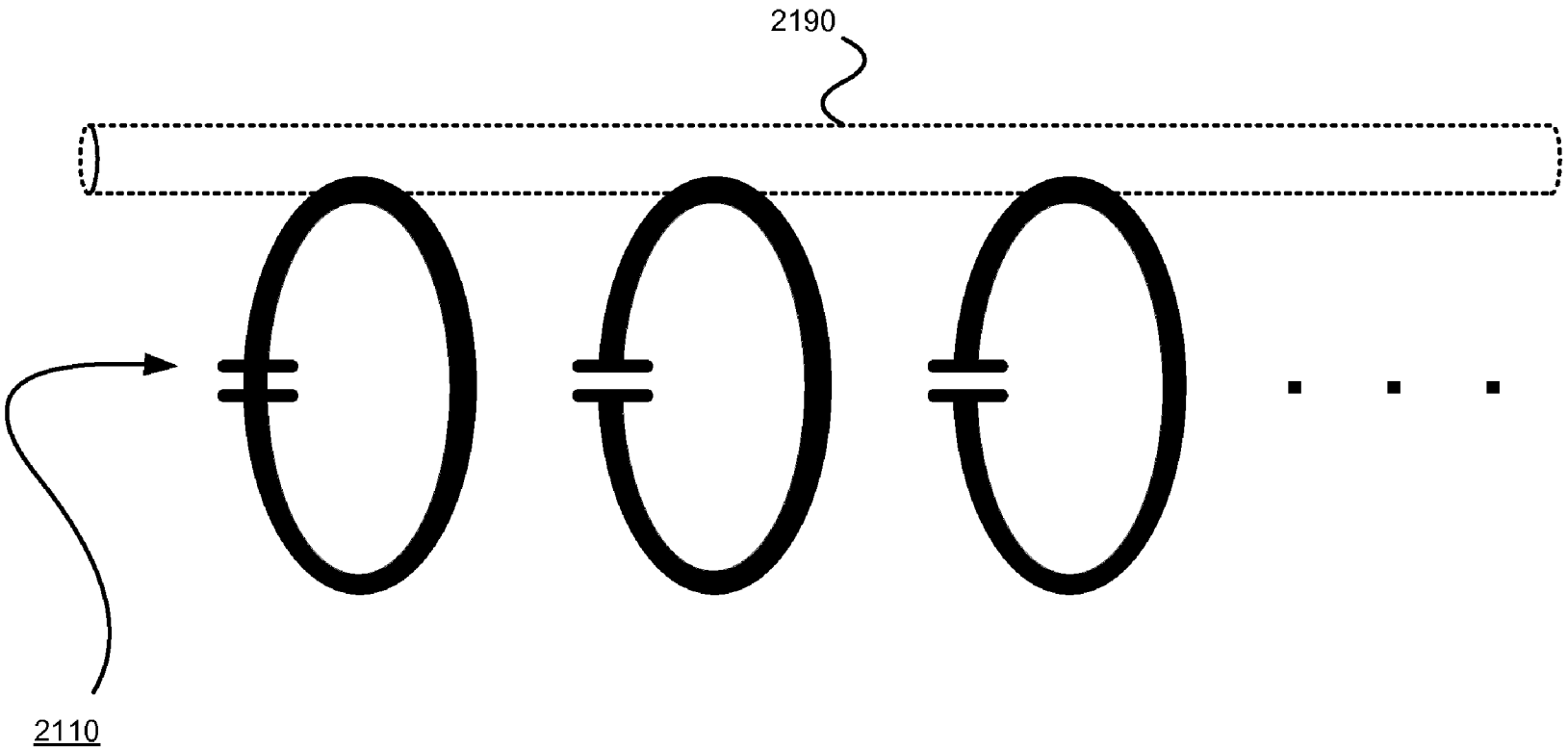

The ring elements may be held in a fixed arrangement by a non-conducting material (e.g., a plastic) in the form of a tube (provided with ring elements on its inner or outer surface), a rod or parallel piped (to which ring elements are regularly attached), a web or mesh sleeve (to which ring elements are regularly attached), etc. The non-conducting material may be rigid, or may flex (preferably without material shape memory). It may be desirable to limit the radius of curvature of the flex as a function of the wavelength of the signal to be carried. For example, FIG. 19 illustrates an exemplary embodiment in which ring elements of a free-space waveguide 1910 are arranged (e.g., fixed with adhesive, friction fit, partially enclosed, etc.) within a non-conducting tube 1990. In some embodiments consistent with the present invention, the ring elements can be completely embedded in the non conducting material. The non-conducting tube 1990 may be rigid or bendable. As another example, FIG. 20 illustrates an exemplary embodiment in which ring elements of a free-space waveguide 2010 are arranged (e.g., fixed with adhesive, friction fit, fastened, partially enclosed, etc.) on the outside surface of a non-conducting tube 2090. The non-conducting tube 2090 may be rigid or bendable. As a final example, FIG. 21 illustrates an exemplary embodiment in which ring elements of a free-space waveguide 2110 are arranged (e.g., fixed with adhesive, friction fit, fastened to, etc.) on a non-conducting rod 2190. The non-conducting rod 2190 may be rigid or bendable. Although not shown, a plurality of rods 2190 may be provided.

The capacitor portion of each ring element might be defined by an external capacitor electrically coupled with the ring element. Alternatively, or in addition, the capacitor portion of each ring element might be defined by a gap in the material of the ring element itself, with the gap being filled with air or some other dielectric material.

Although a free-space waveguide can have ring elements spaced at up to 0.5 of the wavelength of the signal (or power) being transmitted, this spacing will not work as well under shorter lengths than longer lengths. In some embodiments consistent with the present invention, the ring elements are spaced at up to 0.33 of the wavelength of the signal being transmitted.

Simulations have shown good results for a free-space waveguide having 301 ring elements spaced 0.022 wavelength of the signal being transmitted. (See, the paper Pavel Borodulin, "Properties of Arrays of Coaxial, Uniform-Current, Reactively Loaded, Circular Current Loops with Center Loop Excitation," Masters Thesis, Department of Electrical and Computer Engineering, Polytechnic University, January 2008 (incorporated herein by reference).) For a signal with a carrier frequency of 100 MHz, a 0.022 wavelength would be approximately 6 cm apart. Naturally, the ring elements could be spaced more closely.

Although embodiments consistent with the present invention have been described in the context of signal (e.g., data) transmission, free-space waveguides consistent with the present invention can also be used advantageously for power transmission.

Although the ring elements of at least some exemplary free-space waveguides were described as being co-axial (along a linear axis), such ring elements can be arranged on a bent axis. Similarly, such ring elements can be offset. However, the radius of curvature of the bend, and/or the amount of offset may be limited as a function of the wavelength of the signal being carried. Alternatively, or in addition, the ring elements may be provided with closer spacing in the region of a bend and/or an offset.

Although the ring elements of at least some exemplary free-space waveguides were described having parallel planes, such ring elements can be slightly skewed with respect to one another. However, the amount of skew may be limited as a function of the wavelength of the signal being carried.

Finally, although the ring elements of at least some exemplary free-space waveguides were described as being regularly spaced, such regular spacing is not necessary. However, regularly spacing the ring elements at up to 0.5 of the wavelength of the signal being carried advantageously saves material.

§4.5 Conclusions

As should be appreciated from the foregoing, embodiments consistent with the present invention permit signals to be "carried" from a source point to a load (or sink) point by means without various disadvantages of cables, waveguides and transmit and receive antennas. For example, less material is needed. Further signal power is preserved. These first two advantages are particularly important for "long haul" transmission applications. Furthermore, non-conducting intervening material (such as brick, cement, wood, sheetrock, etc.) should not disrupt radiation being transmitted by a free-space waveguide consistent with the present invention. Thus, rather then breaking or boring through material, a free-space waveguide consistent with the present invention may be provided on two sides of solid material. Finally, under the theory of reciprocity, since radiation of the signal being carried does not "leak out" of the waveguide space, radiation of external signals should not leak in to the waveguide space.

What is claimed is:

1. A free-space waveguide for transmitting a signal, having a wavelength lambda, from an input end to an output end, the free-space waveguide comprising a plurality of conducting ring elements, each of the plurality of conducting ring elements a) being separated from at least one adjacent conducting ring element by a distance of less than lambda/2, b) including a capacitor portion, c) having a ring radius of a, and d) having a strip width of W, wherein a capacitance of the capacitor portion has a capacitive reactance which is equal and opposite to an effective inductance L seen at the input of each conducting ring element, while they are all operating together.

2. The free-space waveguide of claim 1 wherein the plurality of conducting ring elements are arranged along a common axis.

3. The free-space waveguide of claim 1 wherein each of the plurality of conducting ring elements defines a plane and wherein the planes defined by the plurality of conducting ring element are parallel.

4. The free-space waveguide of claim 1 wherein at least some of the plurality of conducting ring elements are joined to a common non-conducting element.

5. The free-space waveguide of claim 4 wherein the common non-conducting element is a sleeve within which the at least some of the plurality of conducing ring elements are arranged.

6. The free-space waveguide of claim 4 wherein the common non-conducing element is a rigid tube within which the at least some of the plurality of conducing ring elements are arranged.

7. The free-space waveguide of claim 4 wherein the common non-conducing element is a flexible tube within which the at least some of the plurality of conducing ring elements are arranged.

8. The free-space waveguide of claim 4 wherein the common non-conducing element is a rigid tube having an outer surface on which the at least some of the plurality of conducing ring elements are arranged.

9. The free-space waveguide of claim 4 wherein the common non-conducing element is a flexible tube having an outer surface on which the at least some of the plurality of conducing ring elements are arranged.

10. The free-space waveguide of claim 1 wherein the capacitor portion includes a separate capacitor element.

11. The free-space waveguide of claim 1 wherein the capacitor portion is defined by a gap in the ring element.

12. A system comprising:

a) an input source for sourcing a signal having a wavelength lambda;

b) a free-space waveguide for transmitting a signal having a wavelength lambda from an input end to an output end, the free-space waveguide comprising a plurality of conducting ring elements, each of the plurality of conducting ring elements (1) being separated from at least one adjacent conducting ring element by a distance of less than lambda/2, (2) including a capacitor portion, (3) having a ring radius of R, and (4) having a strip width of W, wherein a capacitance of the capacitor portion has a capacitive reactance which is equal and opposite to an effective inductance L seen at the input of each conducting ring element, while they are all operating together;

c) an output load for sinking the signal;

d) an input matching circuit for coupling the input source with the input end of the free-space waveguide; and e) an output matching circuit for coupling the output load with the output end of the free-space waveguide.

13. The system of claim 12 wherein the capacitor portion includes a separate capacitor element.

14. The system of claim 12 wherein the capacitor portion is defined by a gap in the ring element.

15. A method comprising:

a) providing a free-space waveguide for transmitting a signal, having a wavelength lambda, from an input end to an output end, the free-space waveguide comprising a plurality of conducting ring elements, each of the plurality of conducting ring elements (1) being separated from at least one adjacent conducting ring element by a distance of less than lambda/2, (2) including a capacitor portion, (3) having a ring radius of R, and (4) having a strip width of W, wherein a capacitance of the capacitor portion has a capacitive reactance which is equal and opposite to an effective inductance L seen at the input of each conducting ring element, while they are all operating together;

b) receiving a signal having a wavelength lambda provided to the input end of the free-space waveguide; and c) providing the signal at the output end of the free-space waveguide.

* * * * *